US007086560B2

(12) United States Patent
Shioya

(10) Patent No.: US 7,086,560 B2
(45) Date of Patent: Aug. 8, 2006

(54) VENDING MACHINE

(75) Inventor: Morihisa Shioya, Nitta-gun (JP)

(73) Assignee: Sanden Corp., Gunma (JP)

( * ) Notice: Subject to any disclaimer, the term of this patent is extended or adjusted under 35 U.S.C. 154(b) by 181 days.

(21) Appl. No.: 10/807,316

(22) Filed: Mar. 24, 2004

(65) Prior Publication Data

US 2004/0188455 A1 Sep. 30, 2004

(30) Foreign Application Priority Data

Mar. 28, 2003 (JP) ..... 2003-090697
Feb. 17, 2004 (JP) ..... 2004-039812

(51) Int. Cl.
*G07F 11/00* (2006.01)

(52) U.S. Cl. ..... 221/191; 221/210; 221/220; 221/285

(58) Field of Classification Search ..... 221/191, 221/192, 210, 219, 220, 285, 288, 289; 211/59.2, 211/59.4, 151
See application file for complete search history.

(56) References Cited

U.S. PATENT DOCUMENTS 4,812,629 A * 3/1989 O'Neil et al. ..... 235/383
5,139,384 A * 8/1992 Tuttobene ..... 414/281
5,143,193 A * 9/1992 Geraci ..... 194/212
5,385,265 A * 1/1995 Schlamp ..... 221/7
5,555,793 A * 9/1996 Tocchet et al. ..... 99/326
5,788,090 A * 8/1998 Kajiwara ..... 211/59.2
6,006,946 A * 12/1999 Williams et al. ..... 221/9
6,597,970 B1 * 7/2003 Steury et al. ..... 700/242
6,682,289 B1 * 1/2004 Credle, Jr. ..... 414/281

FOREIGN PATENT DOCUMENTS

JP 2000-259939 9/2000

* cited by examiner

*Primary Examiner*—Khoi H. Tran
(74) *Attorney, Agent, or Firm*—Banner & Witcoff, Ltd.

(57) ABSTRACT

A vending machine adopts a storing tray capable of storing a plurality of commodities in an upright state as storing means, and adopts means including a hand unit capable of gripping the commodity located at a taking-out portion of a predetermined storing tray as remaining in an upright state and a mechanism capable of moving the hand unit up and down, left and right, and back and forth as a common carrying-out means by a plurality of storing means. This allows the constitution of the storing means to be simplified, and the necessity of providing the carrying-out means for every storing means is eliminated so that the manufacturer's cost of the vending machine can be reduced.

10 Claims, 32 Drawing Sheets

VENDING MACHINE

BACKGROUND OF THE INVENTION (i) Field of the Invention

The present invention relates to a vending machine capable of vending various types of commodities.

(ii) Description of the Related Art

In general, a vending machine for vending commodities such as canned beverage, bottled beverage, pet-bottled beverage and the like comprises a plurality of serpentine type racks as commodity storing means, and comprises a see-saw type vending mechanism as commodity carrying-out means provided at the bottom of each rack.

The commodities are inserted sidewise into an inlet provided on the top end portion of the rack, and are stored in a stacked state in a sidewise position inside a serpentine pathway of the rack. The vending mechanism carries out the commodities at the lowest place within the serpentine pathway of the rack one by one, and the carried out commodities are guided to a vending port through an inclined chute.

The above-described rack and vending mechanism dominate a very high proportion of the manufacture's cost of the vending machine because of the reason that the number of parts constituting them are great, that the assembling work thereof is complicated, that it is necessary to provide the vending mechanism at the bottom of each rack, and the like.

To make profits from the production and distribution of the vending machine under the sluggish economy such as experienced in recent years, it is a must to lower the manufacturing cost of the vending machine itself. However, in the vending machine employing the above-described rack and vending mechanism, since it is difficult to lower the cost more than possible now, a vending machine comprising storing means and carrying-out means as an alternative to the above is eagerly desired.

SUMMARY OF THE INVENTION

The object of the present invention is to provide a vending machine including new storing means and carrying-out means.

To achieve the above-described object, the vending machine of the present invention comprises, a plurality of storing means capable of storing a plurality of commodities in an upright state; gripping means capable of gripping an commodity as remaining in an upright state; and moving means capable of moving the gripping means up and down, right and left, and back-and-forth; wherein after the commodity located at a taking-out position of a predetermined storing means is gripped by the gripping means and taken out, the gripping means is moved to a carrying-out position, and the gripping of the commodity by the gripping means is released at the carrying-out position so as to perform a carrying-out of the commodity.

According to this vending machine, since means capable of storing a plurality of commodities in an upright state is adopted as the storing means, and means comprising the gripping means capable of gripping the commodity located at the taking-out position of the predetermined storing means in an upright state and the moving means capable of moving the gripping means up and down, right and left, and back-and-forth is adopted by a plurality of storing means as a common carrying-out means, it is possible to simplify a constitution of the storing means and eliminate the necessity of providing the carrying-out means for every storing means so that the manufacture's cost of the vending machine can be reduced.

The above-described object and other objects, features, and advantages will become more apparent from the following detailed description taken in conjunction with the accompanying drawings.

DESCRIPTION OF THE PREFERRED EMBODIMENTS

First Embodiment

FIGS. 1 to 14 show a first embodiment of the present invention. In the following description, for the sake of convenience, the front side of FIG. 1 is mentioned as the front, the rear side as the rear, the left side as the left, and the right side as the right.

Figure 1:
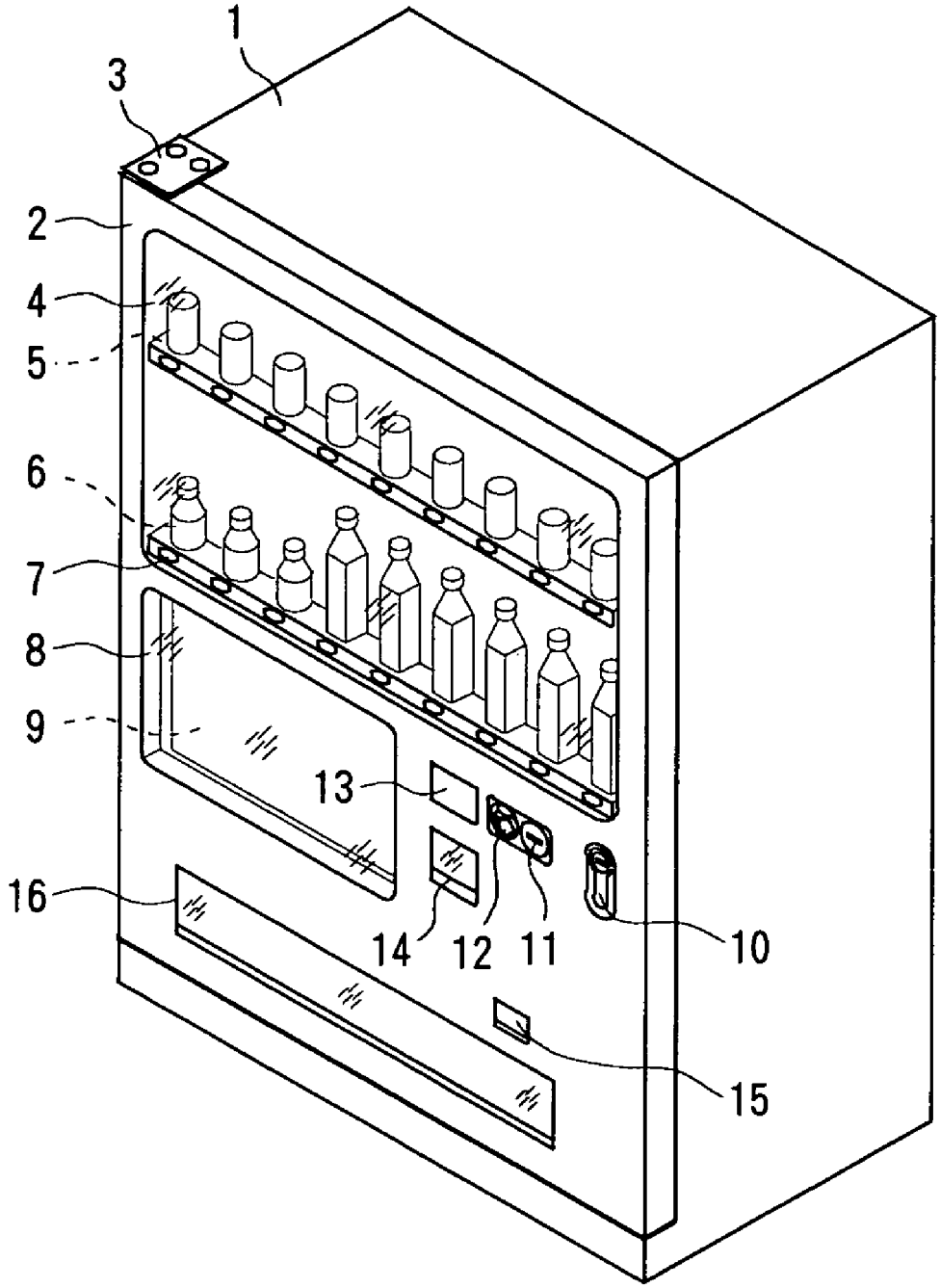
FIG. 1 is an external oblique view of a vending machine showing a first embodiment of the present invention.

FIG. 1 is an external oblique view of a vending machine.

This vending machine comprises a box type cabinet 1 opened in the front, and a door 2 closably covering a front opening. The door 2 is rotatably supported by a bracket 3 provided at the left top surface of the cabinet 1 and a downside-protruding portion.

Inside the cabinet 1, there is provided a thermal insulating chamber la (see FIG. 2) having a sub-door (illustration omitted), and inside this chamber 1*a*, there are provided a plurality of rooms SR1 to SR18. The internal constitution of the cabinet 1 including these rooms SR1 to SR18 will be described later. Further, in the sub-door, there is provided a flap door (illustration omitted) corresponding to a carrying-out port 1*b* (see FIG. 2).

In the upper portion in front of the door 2, there is provided a transparent plate 4 composed of a glass, a transparent plastic and the like, and behind the rear thereof, there is provided a sample chamber (no reference numeral available). Inside the sample chamber, there are a plurality of sample loading tables 5, on each of which is exchangeably loaded a plurality of commodity samples 6 corresponding to stored commodities G1 to G18. Further, in front of the transparent plate 4, there is provided a commodity selection button 7 having a sold out indication function corresponding to each commodity sample 6.

Further, in the left downside of the transparent plate 4 in front of the door 2, there is provided a transparent plate 8 composed of a glass, a transparent plastic and the like, and behind the rear, there is provided an advertising chamber (no reference numeral available). Inside the advertising chamber, there is exchangeably attached an advertising media 9 such as a poster and the like.

Further, in the right downside of the transparent plate 4 in front of the door 2, there are provided a lock operation lever 10, a coin slot 11, a refund lever 12, a slotted amount display 13, a bill slot 14, and a coin return slot 15. The operation lever 10 is for operating a lock mechanism (illustration omitted) provided in the interior side of the door 2, and is put into a usable state by the operation by a key of an exclusive use. Further, in the under-part in front of the door 2, there is provided a commodity vendition port 16.

Note that a mechanism may be adopted such that the transparent plate 4, the sample chamber, the sample loading table 5, the commodity sample 6 and the commodity selection button 7 are eliminated, and instead of them, an image display such as a liquid crystal display with a touch sensor and the like is provided so as to display a plurality of images of the vendible commodities on the image display, and by touching the predetermined commodity image, an commodity selection can be made. If such a mechanism is adopted to allow advertisement and the like to be displayed in a screen, the above-described transparent plate 8 and the advertising medium 9 can be also eliminated. Further, if the slotted amount is allowed to be displayed on the screen, the above-described slotted amount indication portion 13 can be also eliminated.

Figure 2:
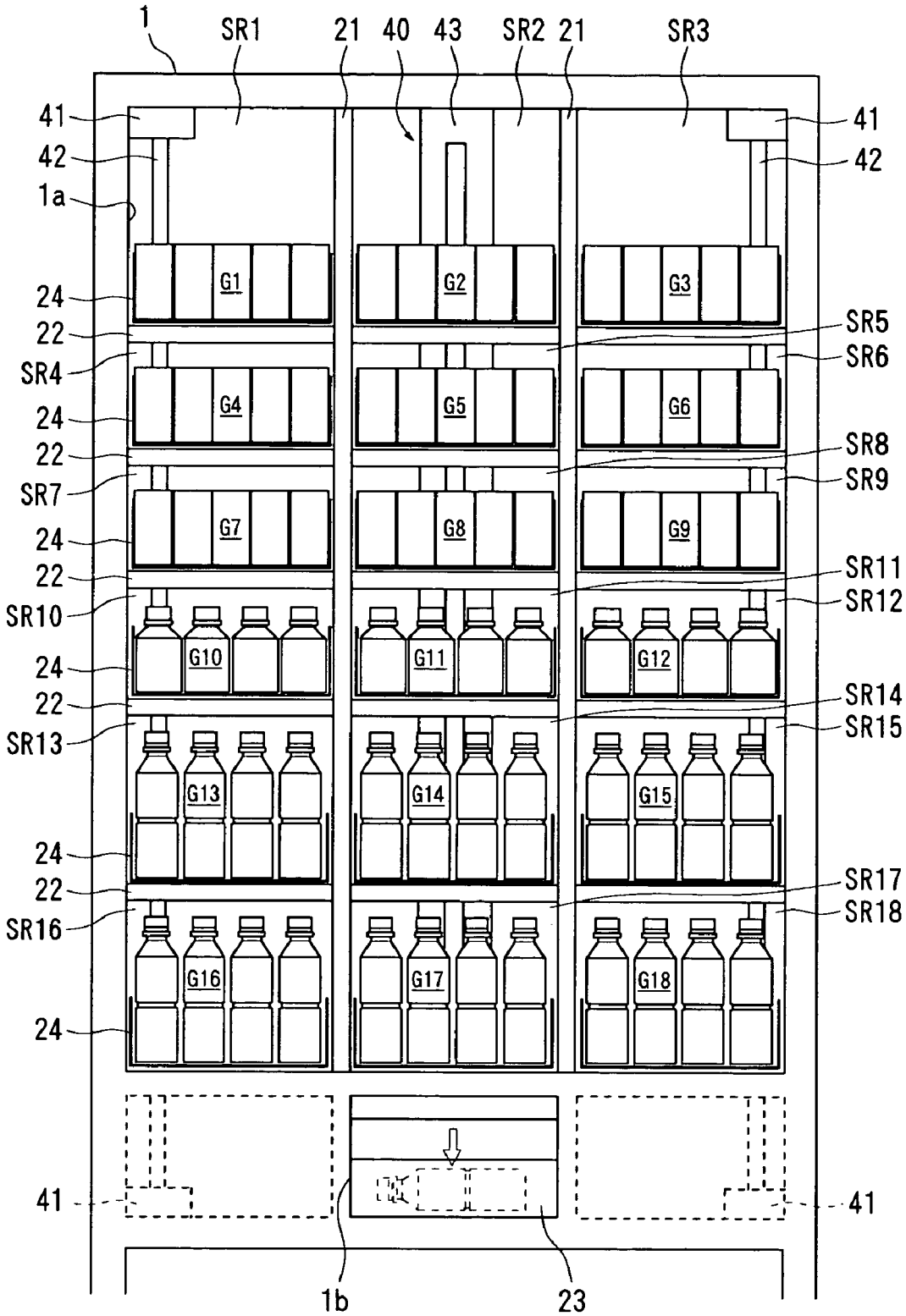
FIG. 2 is a front view of a cabinet except for a sub door.

FIG. 2 is a front view of the cabinet 1 shown in FIG. 1 except for the sub door.

Inside the cabinet 1, two pieces of heat insulating longitudinal plate 21 and five pieces of heat insulating lateral plate 22 are combined, thereby forming a total of 18 pieces of room SR1 to SR18 in the shape of a lattice. Further, inside the carrying-out port 1*b* provided at the under-part of the cabinet 1, there is provided a chute 23 (see FIG. 5) inclined downward from the rear to the front.

The longitudinal dimension of each room SR1 to SR18 is allowed to change for every shelf according to the height of the commodities subject to storage. Further, the top most rooms SR1 to SR3 are provided with an allowance on the upper side thereof in relation to the taking-out operation of the commodities to be described later.

Further, respective rooms SR1 to SR18 are provided drawably with a storing tray 24 having the same shape to be described later, and each storing tray 24 is stored with a plurality of commodities in an upright state. Note that what is meant by the "upright state" here is that the under surface of the commodity contacts the bottom surface of the storing tray 24, and the commodity stands alone.

Incidentally, referring to the illustration, the storing trays 24 of the rooms SR1 to SR9 are stored with nine types of commodities G1 to G9 (canned beverage) by the types, and the storing trays 24 of the rooms SR10 to SR12 are stored with three types of commodities G10 to G12 (bottled beverage) by the types, and the storing trays 24 of the rooms SR13 to SR18 are stored with six types of commodities G13 to G18 (pet-bottled beverage) by the types.

Figure 3A:
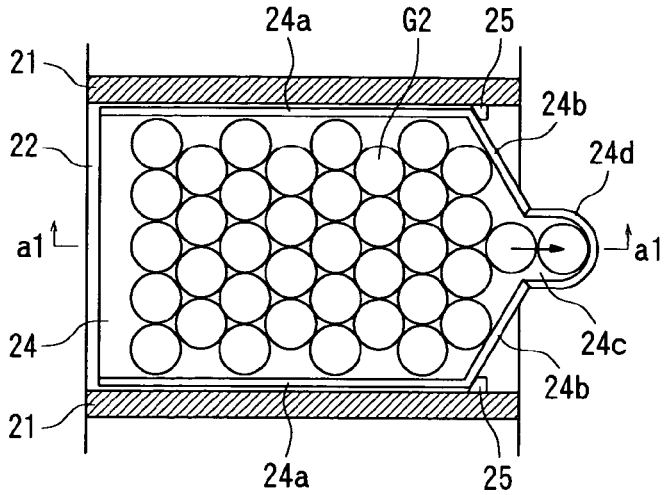
FIG. 3A is a top view of a storing tray.
Figure 3B:
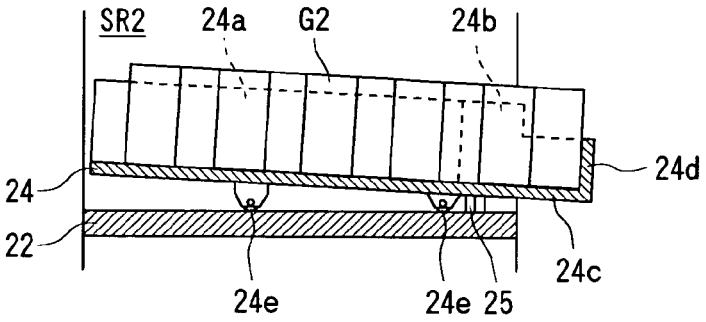
FIG. 3B is a cross sectional view cut in a line a1—a1 in FIG. 3A.

FIG. 3A shows a top view of the storing tray 24 storing the commodity G2, and FIG. 3B shows a view cut in a line a1—a1 in FIG. 3A.

The storing tray 24 comprises a base-shaped bottom surface composed of a metal plate small in skin friction resistance, a plastic plate and the like, and both the right and left edges are provided with flat wall-shaped first guide portions 24*a* coming face to face in parallel with each other. In the rear of the first guide portions 24*a*, there are provided flat wall-shaped second guide portions 24*b*, which are formed in the shape of V-letter, and at the rear ends thereof there is provided a curved wall-shaped stopper portion 24*d* for stopping the commodity G2 at the taking-out portion 24*c*. The first guide portion 24*a*, the second guide portion 24*c*, and the stopper portion 24*d* are continued. The height of the stopper portion 24*d* is about 10 to 30 mm, and is lower than the height of the first guide portion 24*a* and the second guide portion 24*b*.

Further, on the under-part of the storing tray 24, there are provided a plural pieces of traveling roller 24*e* for making the taking out and the return operation of the storing tray 24 easy. This traveling roller 24*e* fulfills the role of inclining the whole storing tray 24 downward from the front to the rear by about 2 to 5 degrees, that is, inclining the commodity G2 after stored to such an extent that it does not fall. In the case that the storing tray 24 is in a state of being at the return position, the taking-out portion 24*c* and the stopper portion 24*d* project further backward than the rear end of the lateral plate 22.

Figure 3C:
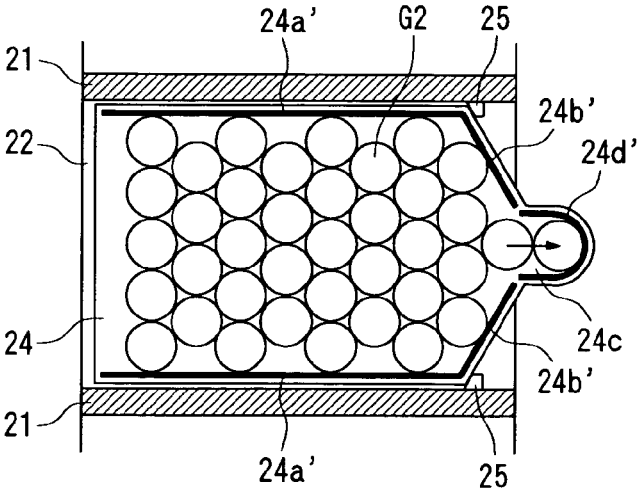
FIG. 3C is a top view of a modified embodiment of the storing tray.

The first guide portion 24*a*, the second guide portion 24*b*, and the stopper portion 24*d* are not necessarily formed in the shape of the wall. As shown in FIG. 3C, a linear member such as a wire and the like disposed along each of the upper end edge may constitute the first guide portion 24*a*', the second guide portion 24*b*', and the stopper portion 24*d*'. Further, a whole or a part except for the taking-out portion 24*c* of the bottom surface of the storing tray 24 may be constituted by a plurality of rollers lined up in parallel back and forth.

In the event that the commodities G2 are stored in the storing tray 24, the storing tray 24 is preferably pulled out more than half from the room SR2, and a plurality of the commodities G2 are loaded in order on the bottom surface in an upright state, and after loading, the storing tray 24 may be pushed back to its original position. In the room SR2, there is provided a stopper 25 for controlling a return position of the storing tray 24, and in a state in which the external surface or other portions of the second guide portion 24*b* abuts against the stopper 25, the commodity taking-out portion 24*c* of the storing tray 24 projects backward from the room SR2.

Since the storing tray 24 is inclined downward from the front to the rear, the commodity G2 loaded on the bottom surface in an upright state moves toward the taking-out portion 24*c* as remaining in an upright state while sliding on the bottom surface, and as shown in FIG. 3A, after gaining entry to the taking-out portion 24*c*, abuts against the stopper portion 24*d* and stops.

Note that the cooling down of the commodities stored in each storing tray 24 can be performed by circulating the air cooled by the evaporator of a refrigeration unit within the chamber la or by guiding the air cooled by the evaporator inside each room through a duct or by laying an evaporative pipe in each room. Further, the warming of the commodities stored in each storing tray 24 can be performed by disposing a hot plate on the bottom surface or the downside of the storing tray 24. Of course, it does not matter if the cooling or the warming of the commodities stored in each storing tray 24 is performed by using other cooling methods or warming methods.

Figure 4:
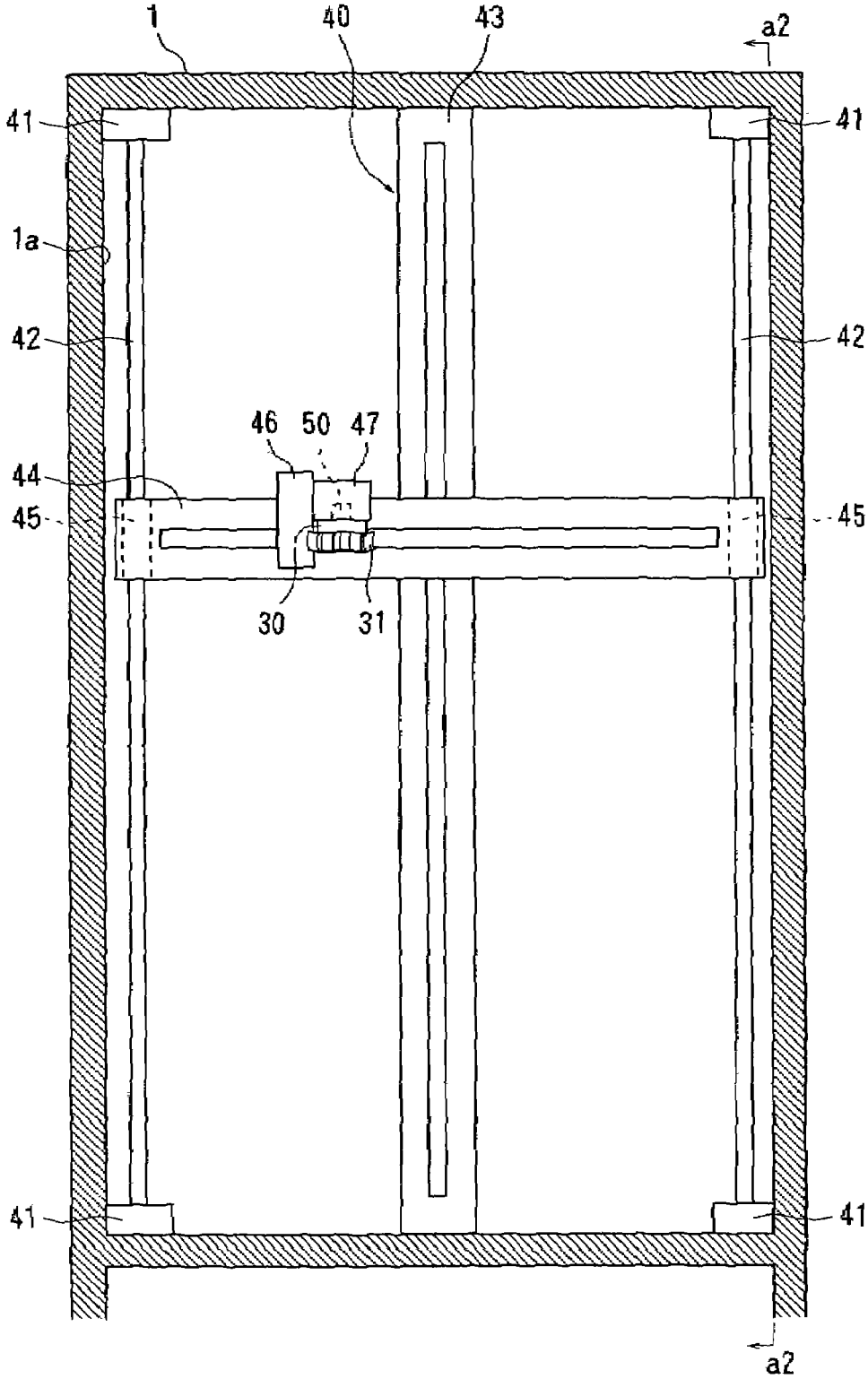
FIG. 4 is a front view of a hand unit and its movement mechanism.
Figure 5:
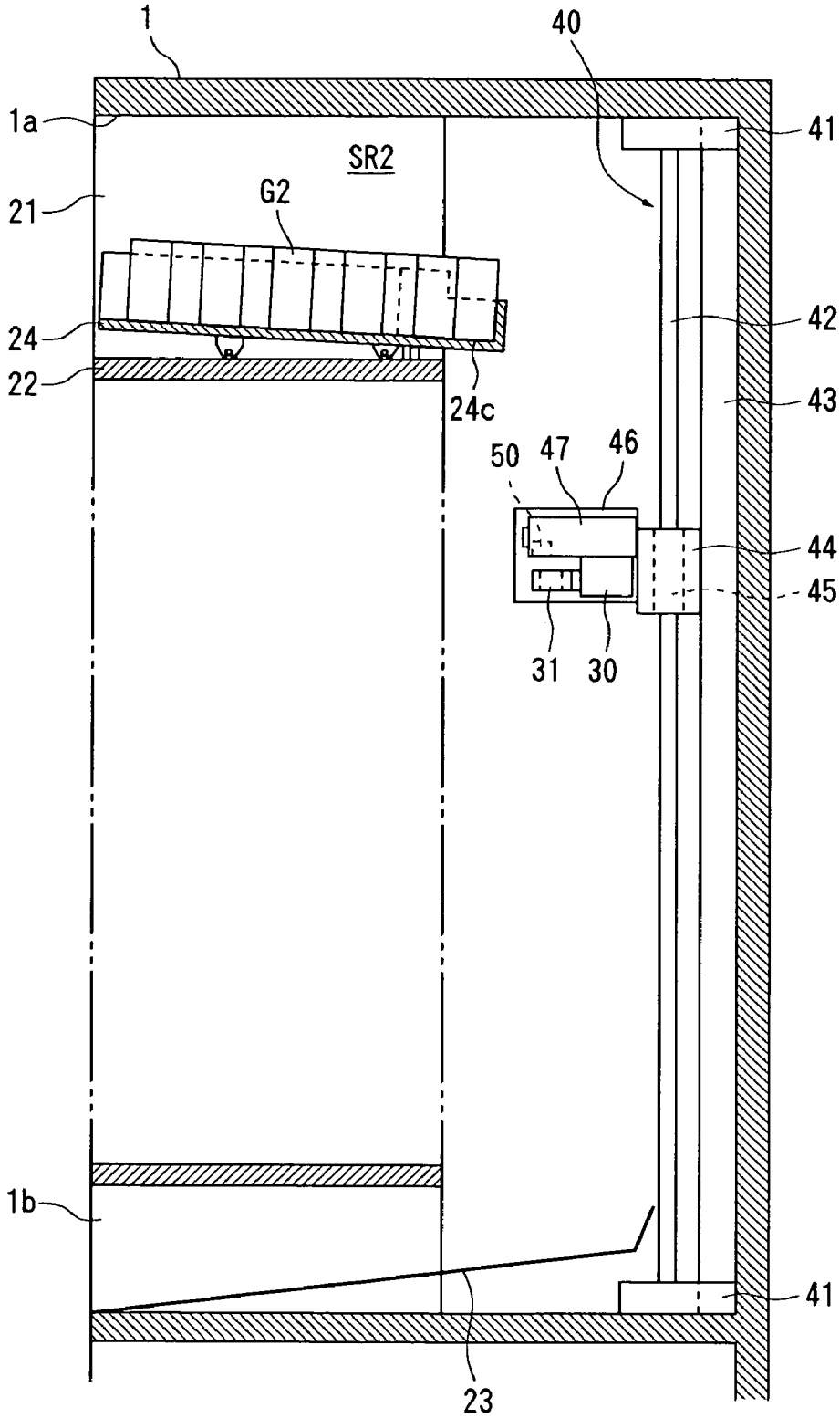
FIG. 5 is a sectional view cut in a line a2—a2 in FIG. 4.

FIG. 4 shows a front view of a hand unit provided at the rear side of the rooms SR1 to SR18 shown in FIG. 2 and its movement mechanism, and FIG. 5 is a sectional view cut in a line a2—a2 in FIG. 4.

The hand unit 30 comprises a pair of curve-shaped left and right fingers 31 and a motor 32 (see FIG. 9) for opening and closing the fingers 31. This hand unit 30 with the finger 31 put into a sideway state is attached to the under-part of a back-and-forth slider 47 to be described later, and can be moved up and down, right and left, and back and forth by a movement mechanism 40 to be described later.

Figure 6A:
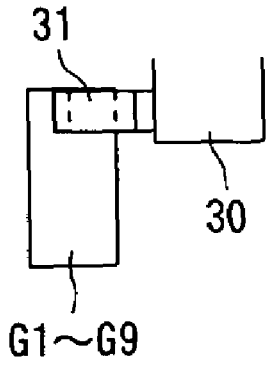
FIG. 6A is a side view showing a gripping state of commodities G1 to G9 by a hand.
Figure 6B:
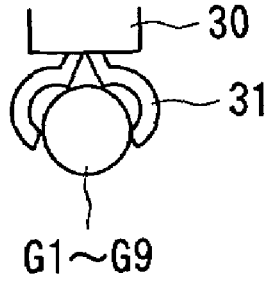
FIG. 6B is a top view thereof.
Figure 7A:
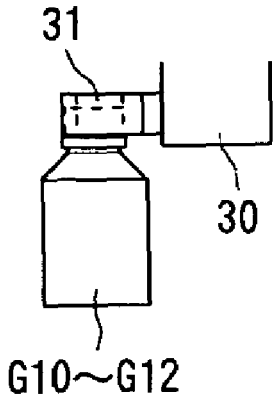
FIG. 7A is a side view showing a gripping state of commodities G10 to G12.
Figure 7B:
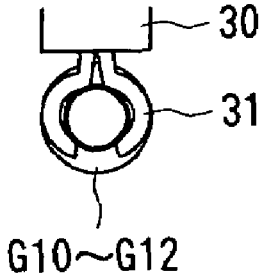
FIG. 7B is a top view thereof.
Figure 8A:
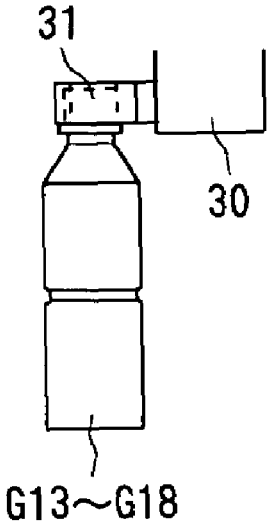
FIG. 8A is a side view showing a gripping state of commodities G13 to G18.
Figure 8B:
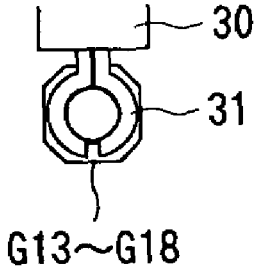
FIG. 8B is a top view thereof.

The finger 31 is in a shape capable of gripping by holding each commodity G1 to G18 in an upright state. Specifically, the canned beverage G1 to G9, as shown in FIGS. 6A and 6B, are gripped with the upper portions thereof held by the finger 31, and the bottled beverage G10 to G12, as shown in FIGS. 7A and 7B, are gripped with the cap portions thereof held by the finger 31, and the pet-bottled beverage G13 to G18, as shown in FIGS. 8A and 8B, are gripped with the cap portions thereof held by the finger 31.

It is a matter of course that a hand unit capable of exerting a gripping force sufficiently to perform a taking-out and a movement of the commodities described later is used as the hand unit 30. However, it is desirable that an anti-slip agent comprised of synthetic rubber, flexible plastic and the like is provided on the interior surface of the finger 31.

The movement mechanism 40 is constituted by a pair of left and right guide rods 42 provided between upper and lower fastening fixtures 41, an up-and-down slider mechanism (illustration omitted) built-in up-and-down drive unit 43, an up-and-down slider 44, a left-and-right slider drive mechanism (illustration omitted) provided inside the up-and-down slider 44, a left-and-right slider 46, a back-and-forth slider drive mechanism (illustration omitted) provided inside the left-and-right slider 46, and a back-and-forth slider 47.

The up-and-down slider drive mechanism comprises a motor 43*a* (see FIG. 9), a ball screw (illustration omitted) connected to a rotational shaft of the motor 43*a*, a nut (illustration omitted) screwed to the ball screw, and guide means (illustration omitted) for controlling the linear movement of the nut. The exposed portion of the nut is connected to the up-and-down slider 44. On both the left and right end portions of this up-and-down slider 44, there is provided a bush 45, and the guide rod 42 is inserted into this bush 45.

The left-and-right slider drive mechanism comprises a motor 44*a* (see FIG. 9), a nut (illustration omitted) screwed into the ball screw, and guide means (illustration omitted) for controlling the linear movement of the nut. The exposed portion of the nut is connected to the left-and-right slider 46.

The back-and-forth slider drive mechanism comprises a motor 46*a* (see FIG. 9), a nut (illustration omitted) screwed in to the ball screw, and guide means (illustration omitted) for controlling the linear movement of the nut. The exposed portion of the nut is connected to the left-and-right slider 46.

Further, on the back-and-forth slider 47, there are provided imaging means for imaging the commodity located in the taking-out portion 24*c* of the storing tray 24 and obtaining an image data thereof, specifically, a color or monochrome camera 50 comprising an imaging element (illustration omitted) such as a CMOS sensor, a CCD sensor and the like, a circuit (illustration omitted) for imaging and outputting image signals based on an external command, and an optical system (illustration omitted).

The image data obtained by this camera 50 is used for information when the up and down position and the left and the right position of the hand unit 30 are corrected before the commodity located at the taking-out portion 24*c* of the predetermined storing tray 24 is gripped by the fingers 31 of the hand unit 30.

Figure 9:
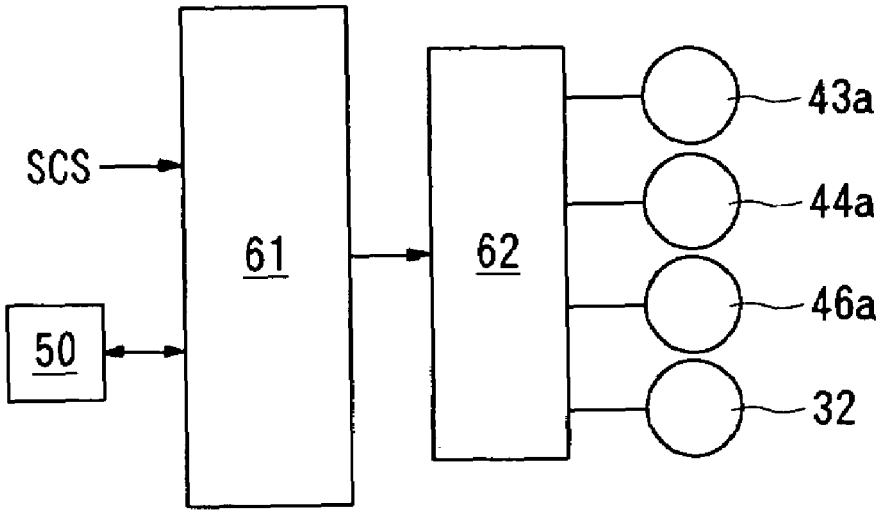
FIG. 9 is a block diagram showing a control system according to a taking-out and a movement of a commodity.

FIG. 9 shows a control system according to a taking-out and a movement of the commodity.

This control system comprises a control circuit 61 of a microcomputer constitution, and a drive circuit 62 for sending a drive signal to the motor 32 of the hand unit 30 and each motor 43*a*, 44*a* and 46*a* of the movement mechanism 40 based on a control signal from the control circuit 61.

While it is preferable to use a pulse motor or a servomotor easy for a position control for the motors 32, 43*a*, 44*a* and 46*a*, it is possible also to use an ordinary DC motor easy for a torque control for the motor 32 for opening and closing the finger 31. Further, the control circuit 61 is connected to the camera 50 through an interface, and is connected to an input line of a vending command signal SCS.

Hereinafter, the operation of the taking-out and the movement of the commodity in the above-described vending machine will be described with reference to FIGS. 10 to 14.

On the occasion of purchasing the commodity, when a purchaser throws a predetermined amount through the coin slot 11 or the bill slot 14 and pushes the commodity selection button 7, the vending command signal SCS corresponding to the selected commodity is inputted to the control circuit 61 from the control system (illustration omitted) according to the vendition of the commodity. This vending command signal SCS includes information for specifying the storing tray 24 storing the selected commodity from among a plurality of storing trays 24.

Figure 10:
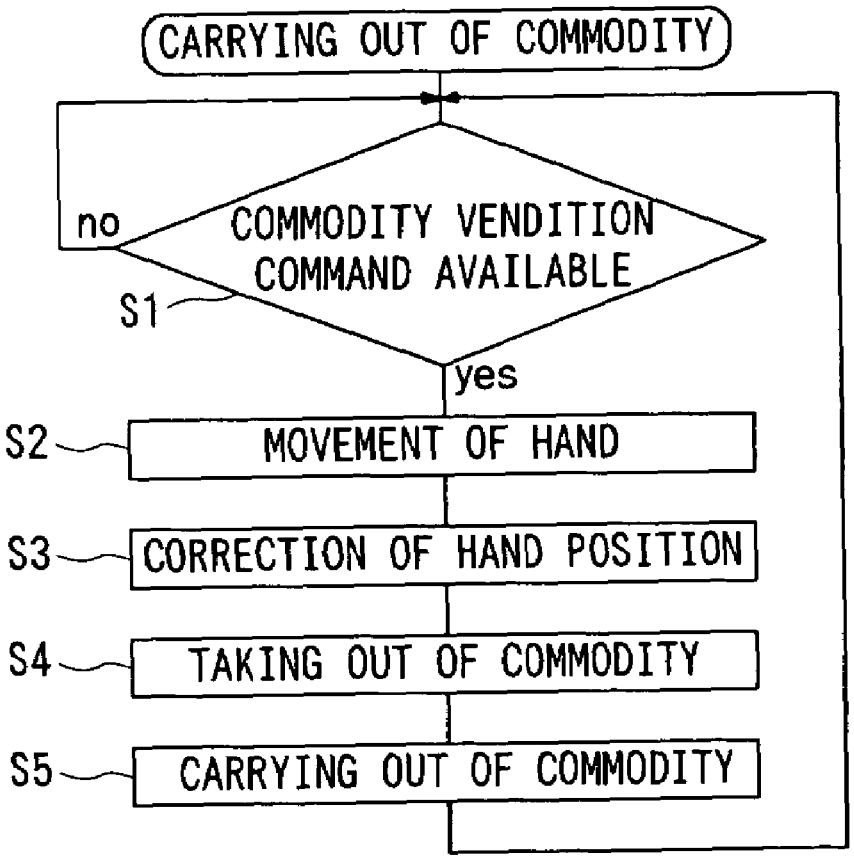
FIG. 10 is a flowchart according to a carrying out of the commodity.
Figure 11:
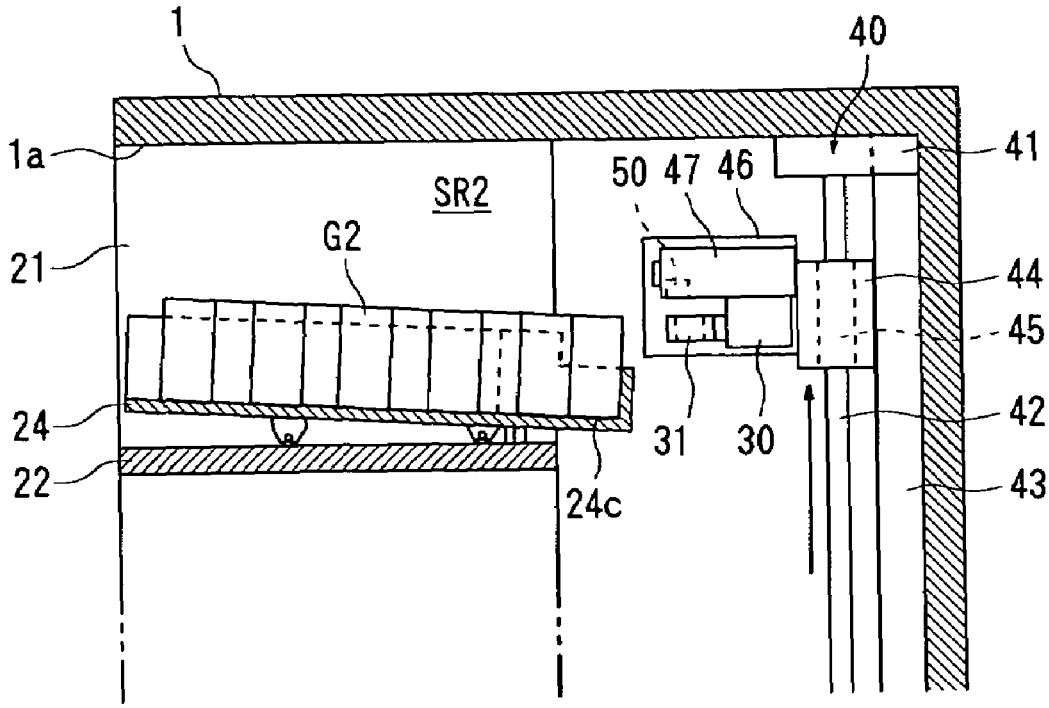
FIG. 11 is an explanatory view of an operation according to the taking-out and the movement of the commodity.

For example, in the case where the vending command signal SCS corresponding to the commodity G2 is inputted to the control circuit 61 (step S1 of FIG. 10), as shown in FIG. 11, the motor 43*a* of the up-and-down slider drive mechanism and the motor 44*a* of the left-and-right slider drive mechanism are allowed to operate so as to move the up-and-down slider 44 and the left-and-right slider 46, and the hand unit 30 located at a waiting position is moved to a position coming face to face with the taking-out portion 24*c* of the storing tray 24 in which the finger 31 stores the commodity G2, and is stopped.

Figure 12:
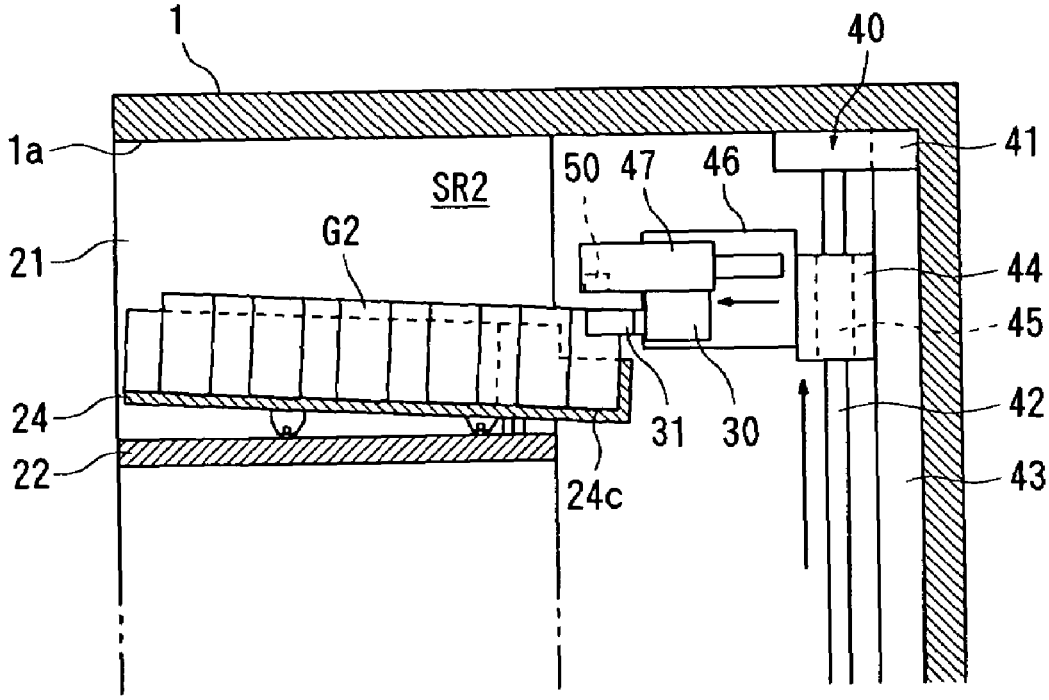
FIG. 12 is an explanatory view of the operation according to the taking-out and the movement of the commodity.

Next, as shown in FIG. 12, with the finger 31 of the hand unit 30 being in a state of spreading to the fullest extent, the motor 46*a* of the back-and-forth slider drive mechanism is operated so as to advance the back-and-forth slider 47, and the hand unit 30 is advanced by a predetermined distance from a retired position, and is stopped (step S2 of FIG. 10).

Since the data of the vertical plane coordinate and the horizontal plane coordinate of the taking-out portion 24*c* of each storing tray 24 can be known in advance by the position of the each storing tray 24 and the length of a rear protrusion of the taking-out portion 24*c*, and furthermore, since the positional data of the gripped places of the commodities G1 to G18 stored in each storing tray 24 can be known in advance by the types of commodities, the movement of the hand unit 30 can be appropriately performed when the vending command signal SCS corresponding to the commodity G2 and other commodities is inputted.

Further, in the event that the hand unit 30 is allowed to advance, an image of the under-part thereof is took in by a camera 50 in the course of moving as occasion demands or an image of the under-part thereof is took in by the camera 50 after moving, and while a pattern matching between the image took in through the camera 50 and a top surface image (template) of the commodity G2 took in advance is performed, the positioning of the hand unit is performed (step S3 of FIG. 10).

When the initial stop position of the hand unit 30 (finger 31) is not appropriate, on the occasion of advancing the back-and-forth slider 47, there are often the cases that the finger 31 interferes with the commodity G2 or mistakes occur in gripping the G2. Hence, in order to allow the gripping of the commodity G2 by the finger 31 to be accurately performed, the motor 43*a* of up-and-down slider drive mechanism and the motor 44*a* of the left-and-right slider drive mechanism are operated so as to move the up-and-down slider 44 and the left-and-right slider 46 based on the image data obtained by the camera 50 when back-and-forth slider 47 is advanced, and a correction of the up-and-down position and the left-and-right position of the hand unit 30 (finger 31) is performed or the motor 43*a* of the up-and-down slider drive mechanism and the motor 44*a* of the left-and-right slider drive mechanism are operated so as to move the up-and-down slider 44 and the left-and-right slider 46 based on the image data obtained by the camera 50 after the back-and-force slider 47 is advanced, thereby correcting the up and down position and the left and right position of the hand unit 30 (finger 31).

Figure 13:
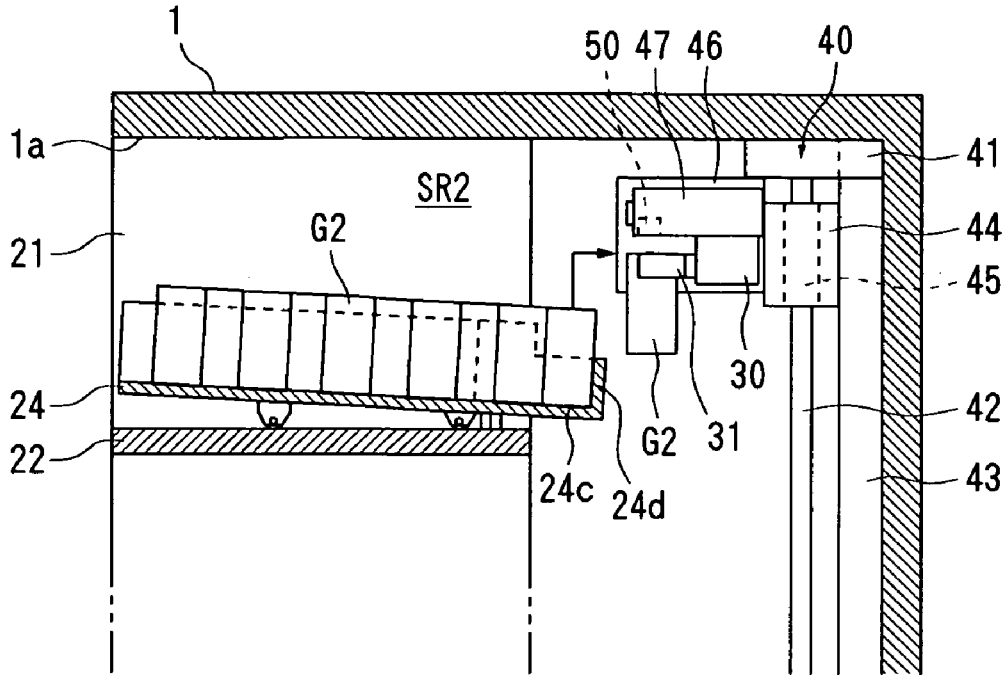
FIG. 13 is an explanatory view of the operation according to the taking-out and the movement of the commodity.

Next, as shown in FIG. 13, the motor 32 of the hand unit 30 is operated, and the finger 31 is closed so as to hold and grip a gripped place of the commodity G2 located in the taking-out portion 24*c*. Subsequently, the motor 43*a* of the up-and-down slider drive mechanism is operated so as to lift the up-and-down slider and raise the commodity G2 gripped by the finger 31 to a position climbing over the stopper 24*d*, so that the commodity is extracted. Then, with the hand unit 30 remaining to be in the gripping state, the motor 46*a* of the back-and-forth slider drive mechanism is operated so as to allow the unit to retreat, and the taking-out of the commodity G2 is performed (step S4 of FIG. 10).

Figure 14:
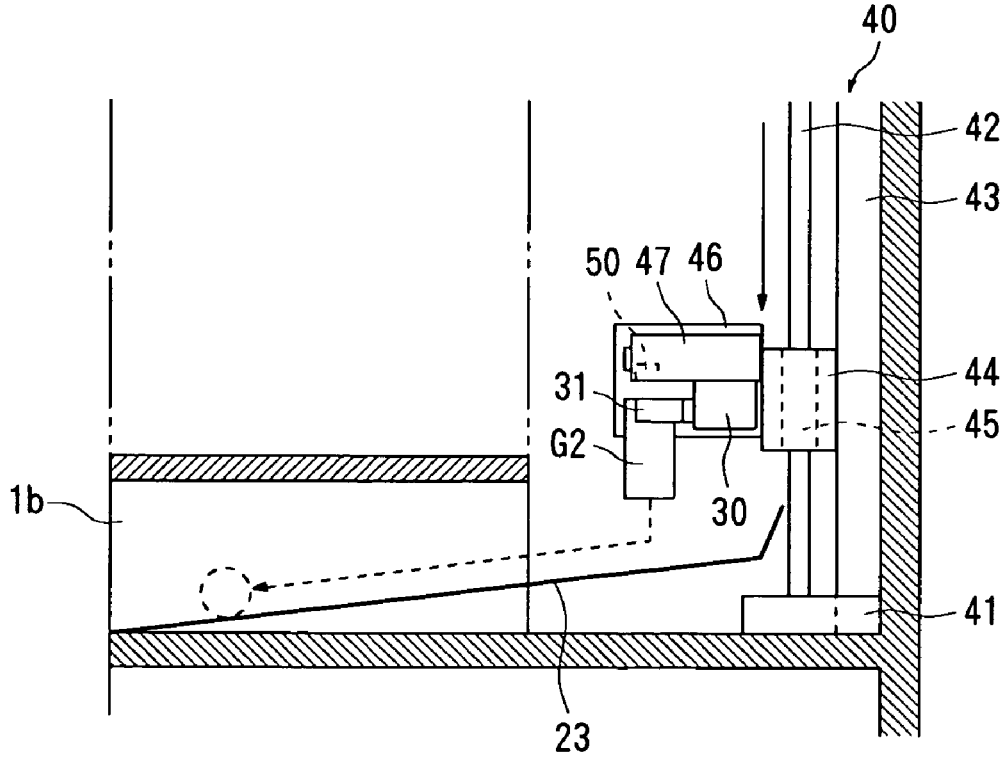
FIG. 14 is an explanatory view of the operation according to the taking-out and the movement of the commodity.

Next, as shown in FIG. 14, the motor 43*a* of the up-and-down slider drive mechanism and the motor 44*a* of the left-and-right slider drive mechanism are operated so as to move the up-and-down slider 44 and the left-and right slider 46, and the commodity G2 gripped by the finger 31 is stopped at a carrying-out position set above at the rear portion of the chute 23. Subsequently, the motor 32 of the hand unit 30 is operated so as to spread the finger 31 to the fullest extent so that the commodity G2 is allowed to fall on the chute 23, thereby performing the carrying out of the commodity (step S5 of FIG. 10). The commodity G2 fell on the chute 23 slides or rotates according to the inclination of the chute 23 so as to move forward, and is delivered to the commodity vendition port 16 of the door 1 through a flap door.

The operations of the taking-out and the movement of commodities G1 and G3 to G18 other than G2 are the same as described above.

In this way, according to the vending machine of the first embodiment, the storing tray 24 capable of storing a plurality of commodities (G1 to G18) in an upright state is adopted as storing means, and the means including the hand unit 30 capable of gripping the commodity (G1 to G18) located at the taking-out portion 24*c* of the predetermined storing tray 24 as remaining in an upright state and the mechanism capable of moving the hand unit 30 up and down, left and right, and back and forth is adopted as common carrying out means by a plurality of storing means (storing tray 24). Hence, the constitution of the storing means can be simplified, and moreover, the necessity of providing the carrying-out means for every storing means can be eliminated, thereby reducing manufacturer's cost of the vending machine. That is, the reduction of manufacturer's cost and the lowering of production cost of the vending machine are made possible, and the profit augmentation due to production and distribution of the vending machine can be attempted.

Further, since the storing tray 24 having the inclined bottom surface for allowing the commodities (G1 to G18) to slide as remaining in an upright state to the taking-out portion 24*c* is used as the storing means, regardless of the number of stored commodities, the movement of the commodity (G1 to G18) to the taking-out portion 24*c* and taking-out of the commodity (G1 to G18) from the taking-out portion 24*c* can be accurately performed by the hand unit 30. Above all, if the bottom surface including a plurality of rollers lined up in parallel back and forth is adapted as the inclined bottom surface, the sliding of the commodities can be made much smoother.

Further, since the moving means comprising the up-and-down slider 44 capable of moving up and down, the up-and-down slider drive mechanism for moving the up-and-down slider 44 up and down, the left-and-right slider 46 provided on the left-and-right slider 44 and capable of moving left and right, the left-and-right slider drive mechanism for moving the left-and-right slider 46 left and right, the back-and-forth slider 47 provided on the left-and-right slider 46 and capable of moving back and forth, and the back-and-forth slider drive mechanism for moving the back-and-forth slider 47 back and forth is used as the moving means of the hand unit 30, it is possible to accurately move the hand unit 30 up and down, right and left, and back and forth and accurately perform the taking-out and the movement of the desired commodity.

Further, since the commodity (G1 to G18) located at the taking-out portion 24*c* of the storing tray 24 is imaged by the camera 50 provided on the back-and-forth slider 47, and based on that image data, the position of the hand unit 30 before gripping the commodity (G1 to G18) located at the taking-out potion 24*c* can be accurately decided, the gripping of the commodity (G1 to G18) by the finger 31 can be accurately performed, thereby preventing the problem such as taking-out mistakes, falling down of the commodity after taken out and the like from occurring.

Hereinafter, a partially modified mode according to the first embodiment will be described.

Figure 15A:
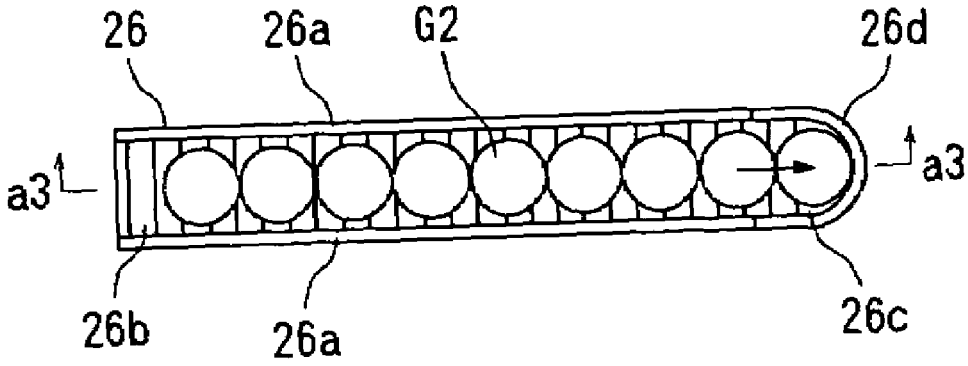
FIG. 15A is a top view showing a modified embodiment of the storing tray.
Figure 15B:
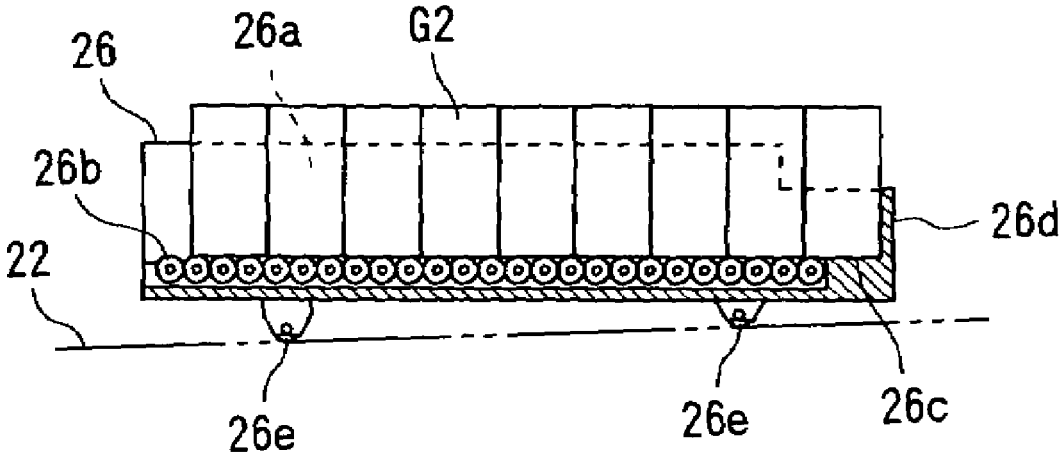
FIG. 15B is a view cut in a line a3—a3 in FIG. 15A.

While the above-described explanation shows the storing tray 24 capable of storing a plurality of commodities (G1 to G18) in a random sequence as the storing tray, means shown in FIGS. 15A and 15B may be used as an alternative to the same.

FIG. 15A shows a top view of a storing tray 26 storing the commodity G2, and FIG. 15B is a cross sectional view cut in a line a3—a3 in FIG. 15A.

This storing tray 26 is for storing the commodity G2 lined up almost in a line, and on both the left and right edges, there are provided frat wall shaped guide portions 26*a* coming face to face in parallel with each other. A plurality of rollers 26*b* lining up in parallel back and forth are provided further forward at the front portion than at the taking-out portion 26*c* of the bottom surface, and on the rear end thereof, there is provided a curved wall-shaped stopper portion 26*d* for stopping the commodity G2 at the taking-out portion 26*c*. The guide portion 26*a* and the stopper portion 26*d* are continued, and the height of the stopper portion 26*d* is lower than the height of the guide portion 26*a*.

Further, on the under surface of the storing tray 26, there are provided a plurality of traveling rollers 26*e* for making the taking-out and the return operation of the storing tray 26 easy, and these traveling rollers 26*e* fulfill the role of inclining the whole storing tray 26 downward from the front to the rear by about 2 to 5 degrees, in other words, inclining the commodity G2 after stored to such an extent that it does not fall down.

The storing tray 26 is designed in a common size for all the commodities (G1 to G18), and is disposed by being lined up plural pieces left and right for each room SR1 to SR18 through partition walls (illustration omitted) and the like to avoid mutual interference.

In the event that the commodity G2 are stored into the storing tray 26, the storing tray 26 is pulled endways, and is preferably pulled out from the room more than half, and a plurality of the commodities G2 are loaded in order on the bottom surface in an upright state, and after loading, the storing tray 26 is pushed back to its original position. In each room, there is provided a stopper (illustration omitted) for controlling the return position of the storing tray 26, and in a state in which a part of the storing tray 26 abuts against the stopper, the taking-out portion 26*c* of the storing tray 26 projects backward from the room. Of course, it does not matter even if the storing of the commodities G2 is performed such that a plurality of commodities G2 are loaded in order on the bottom surface in an upright state without withdrawing the storing tray 26.

Since the storing tray 26 is inclined downward from the front to the rear, the commodity G2 loaded on the bottom surface in an upright state slides on the bottom surface and moves toward the taking-out portion 26*c* while remaining in an upright state, and as shown in FIG. 15A, after gaining entry to the taking-out portion 26*c*, abuts against the stopper portion 26*d* and stops.

Similarly with the above-described tray 24, since the data of the vertical plane coordinate and the horizontal plane coordinate of the taking-out portion 26*c* of each storing tray 26 can be known in advance by the position of each room and the length of a rear protrusion of the taking-out portion 26*c* of the storing tray 26, and furthermore, since the positional data of the gripped places of the commodities G1 to G18 stored in each storing tray 26 can be known in advance by the types of commodities, the forward movement of the back-and-forth slider 47 (hand unit 30) can be appropriately performed when the vending command signal SCS corresponding to the commodity G2 and other commodities G1, G3 to G18 is inputted.

Further, while the above-described explanation shows the hand unit 30 having a pair of left and right fingers 31 as the hand unit, the hand unit having more than two pairs of the fingers may be used as the hand unit 30, so that the commodities may be gripped by gripping two places different in height and position at the same time. Further, the hand unit having more than two downward fingers is used, so that the upper portion of each commodity (G1 to G18) may be grasped and gripped by these fingers.

Further, while the above-described explanation shows the storing trays 24 and 26 slightly inclined downward from the front to the rear in order to guide the commodities (G1 to G18) to the taking-out portion, if the moving stroke of the back-and-forth slider 47 is made larger and the hand unit having the downward finger as described above is used as the hand unit 30, the taking-out portion of the commodity in the interior side of the storing tray having no inclination is detected by the camera 50 while the back-and-forth slider 47 is moved forward, thereby making it possible to take out the commodities on the storing tray by the hand unit 30 one by one.

Second Embodiment

FIGS. 16 to 42 show a second embodiment of the present invention. In the following explanation, for the sake of convenience, the front side of FIG. 16 is mentioned as the front, the rear side as the rear, and the left side as the left and the right side as the right.

Figure 16:
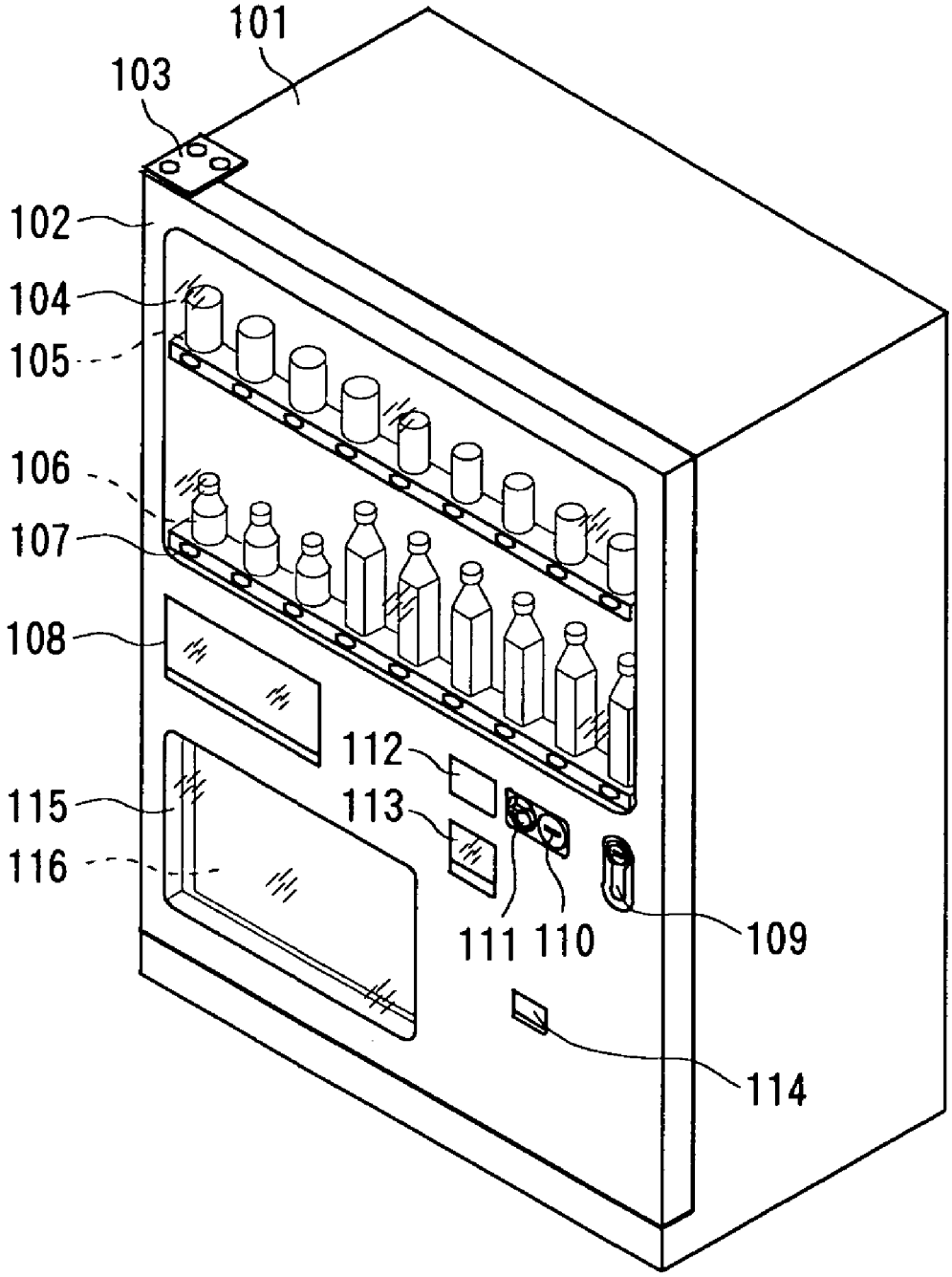
FIG. 16 is an external oblique view of a vending machine showing a second embodiment of the present invention.

FIG. 16 shows an external oblique view of a vending machine.

This vending machine comprises a box type cabinet 101 opened in the front, and a door 102 closably covering the front opening of the cabinet 101. The door 102 is rotatably supported by a bracket 103 having its crosswise direction left portion provided on a left top surface of the cabinet 101, and a downside protruding portion.

Inside the cabinet 101, there is provided a thermal insulating chamber 101*a* (see FIG. 17) having a sub-door (illustration omitted), and inside this chamber 101*a*, there are provided a plurality of rooms SR101 to SR106. The internal structure of the cabinet 101 including these rooms SR101 to SR106 will be described later. Further, in the sub-door, there is provided a flap door (illustration omitted) corresponding to an commodity taking-out port 108 (see FIG. 1).

In the upper portion of the front of the door 102, there is provided a transparent plate 104 comprised of a glass, a transparent plastic and the like, and behind the rear thereof, there is provided a sample chamber (no reference numeral available). Inside the sample chamber, there are provided a plurality of sample loading tables 105, on each of which is exchangeably loaded a plurality of commodity samples 106 corresponding to the stored commodities C1 to C18. Further, in front of the transparent plate 104, there is provided a commodity selection button 107 having a sold out indication function corresponding to each commodity sample 106.

Further, in the left downside of the transparent plate 104 in front of the door 102, there is provided a commodity vendition port 108.

Further, in the right downside of the transparent plate 104 in front of the door 102, there are provided a lock operation lever 109, a coin slot 110, a refund lever 111, a slotted amount display 112, a bill slot 113, and a coin return slot 114. The operation lever 109 is for operating a lock mechanism (illustration omitted) provided in the interior side of the door 102, and is put into a usable state by the operation by an exclusive key.

Further, on the downside of the commodity vendition port 108 in front of the door 102, there is provided a transparent plate 115 comprising a glass, a transparent plastic and the like, and behind the rear thereof, there is provided an advertising chamber (no reference numeral available). Inside the advertising chamber, there is exchangeably attached an advertising media 116 such as a poster and the like.

Note that a mechanism may be adopted such that the transparent plate 104, the sample chamber, the sample loading table 105, the commodity sample 106 and the commodity selection button 107 are eliminated, and instead of them, an image display such as a liquid crystal display with a touch sensor and the like is provided so as to display a plurality of images of the vendible commodities on the image display, and by touching the predetermined commodity image, an commodity selection can be made. If such a mechanism is adopted to allow advertisement and the like to be displayed in a screen, the above-described transparent plate 115 and the advertising medium 116 can be also eliminated. Further, if the slotted amount is allowed to be displayed, the above-described slotted amount indication portion 112 can be also eliminated.

Figure 17:
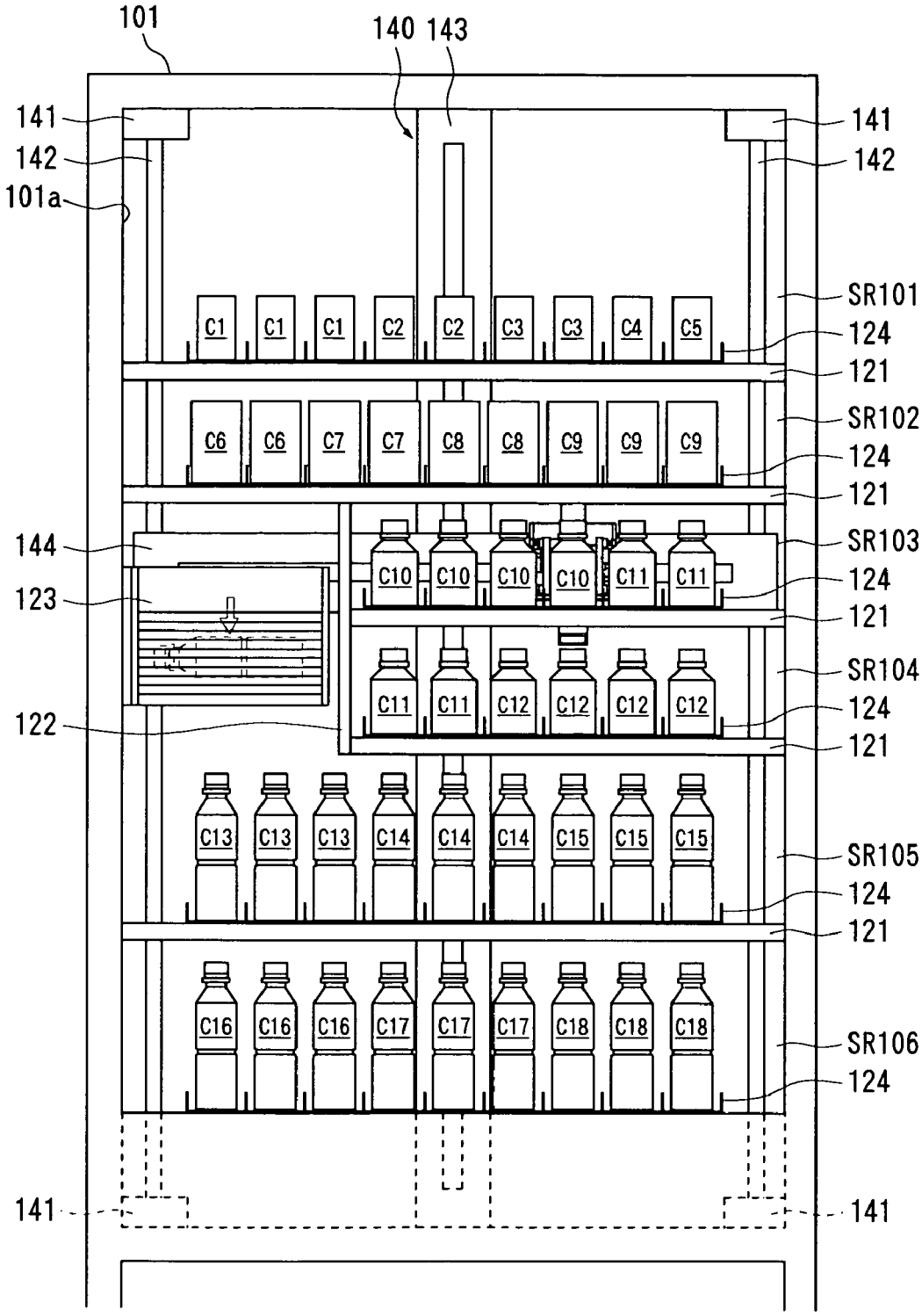
FIG. 17 is a front view of the cabinet except for the sub door.

FIG. 17 is a front view of the cabinet 101 shown in FIG. 16 except for the sub door.

Inside the cabinet 101, five pieces of heat insulating lateral plates 121 and one piece of a heat insulating longitudinal plate 122 and are combined, thereby forming a total of 6 pieces of room SR101 to SR106 in the shape of a lattice. Further, inside the carrying-out port 101*a*, there is provided a chute 123 (see FIG. 42) inclined downward from the rear side to the front side. The bottom surface of the chute 123 consists of a plurality of rollers 123*a* arranged in parallel back and forth, and a wall 123*b* is provided in the back side and the right and left sides thereof to prevent commodities from falling.

The longitudinal dimension of each room SR101 to SR106 is allowed to change for every shelf according to the height of the commodities subject to storage. Further, on the top most room SR101, there is provided with an allowance on the upper side thereof in relation to the taking-out operation of the commodities to be described later.

Further, respective rooms SR101 to SR106 are provided detachably attachable with a storing tray 124 having the same width depending on the lateral size of the rooms SR101 to SR106 to be described later, and a storing portion 124*a* of each storing tray 124 is stored with a plurality of commodities in an upright state. Note that what is meant by the "upright state" here is that the under surface of the commodity contacts the bottom surface of the storing portion 124*a* of the storing tray 124, and the commodity stands alone.

Incidentally, referring to the illustration, the storing trays 124 of the room SR101 are stored with five types of commodities C1 to C5 (canned beverage) by the types, the storing trays 124 of the room SR102 are stored with four types of commodities C6 to C9 (canned beverage) having diameters greater than diameters of commodities C1 to C5 by the types, and the storing trays 124 of the rooms SR103 and 104 are stored with three types of commodities C10 to C12 (bottled beverage) by the types, and the storing trays 124 of the rooms SR105 and SR106 are stored with six types of commodities G13 to G18 (bottled beverage) by the types.

Figure 18A:
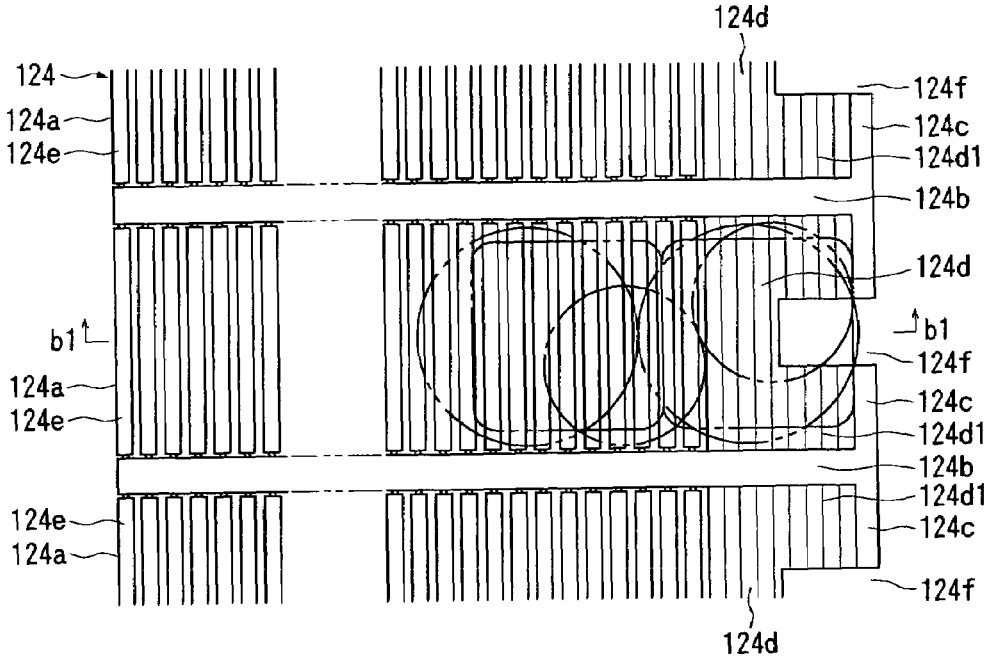
FIG. 18A is a top view of a storing tray.
Figure 18B:
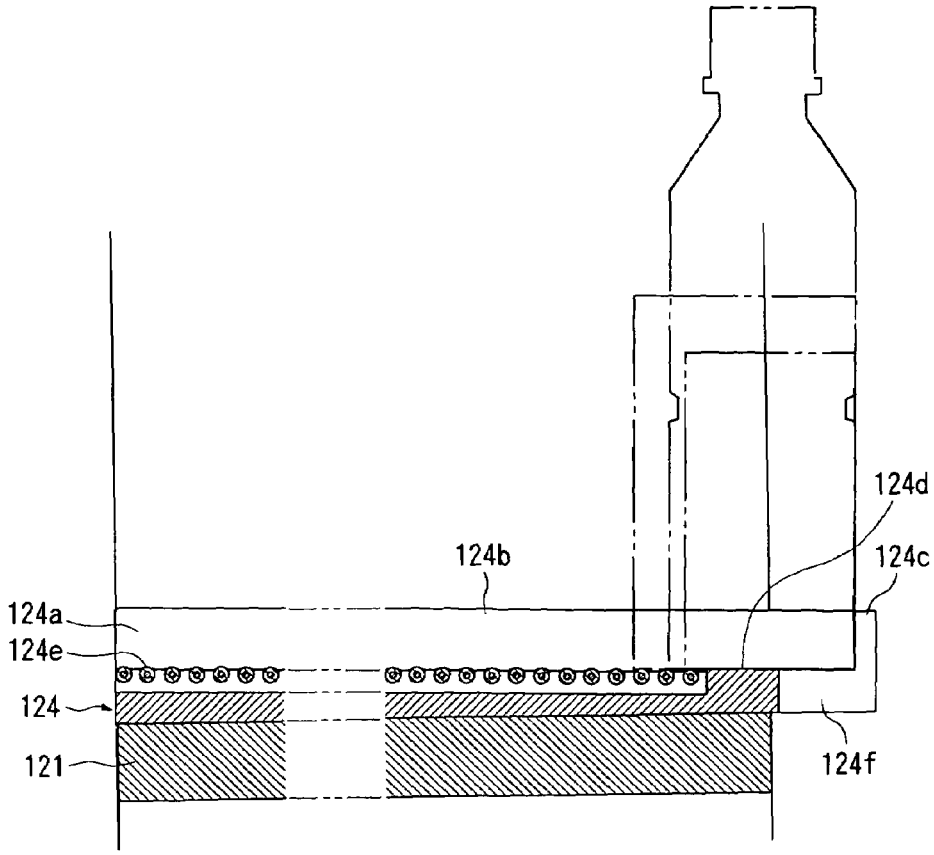
FIG. 18B is a view cut in a line b1—b1 in FIG. 18A.

FIG. 18A shows a top partial view of the storing tray 124, and FIG. 18B shows a view cut in a line b1-b1 in FIG. 18A.

The storing tray 124 comprises the storing portions 124*a* for storing the commodities lined up almost in a line in an upright state in parallel left and right. Each storing portion 124*a* comprises a bottom surface (no reference numeral available) inclined downward by about 2 to 5 degrees from the front to the rear, a frat wall-shaped guide portion 124*b*, provided on both the left and right edges of the bottom surface and coming face to face with each other, and a frat wall-shaped stopper portion 124*c* provided on the rear end portion of the bottom surface. The guide portion 124*b*, is shared by the adjacent storing portion 124*a*.

The bottom surface of each storing portion 124*a* comprises a taking-out portion 124*d* provided on its rear end portion, and a plurality of rollers 124*e* provided in front of the taking-out portion 124*d* and lined up in parallel back and forth. Further, in the center of the stopper portion 124*c*, there is provided a rectangular notch 124f reaching the taking-out portion 124*d*. The guide portion 124*b*, and the stopper portion 124*c* are continued, and the height of both of them is about 10 to 30 mm. In a state in which each storing tray 124 is attached to the lateral plate 121, a part of the stopper portion 124*c* and the taking-out portion 124*d* projects backward from the rear end of the lateral plate 121. Further, on the top surface of each taking-out portion 124*d*, there is formed a horizontal line pattern 124*d*l used for an image processing to be described later.

Figure 19:
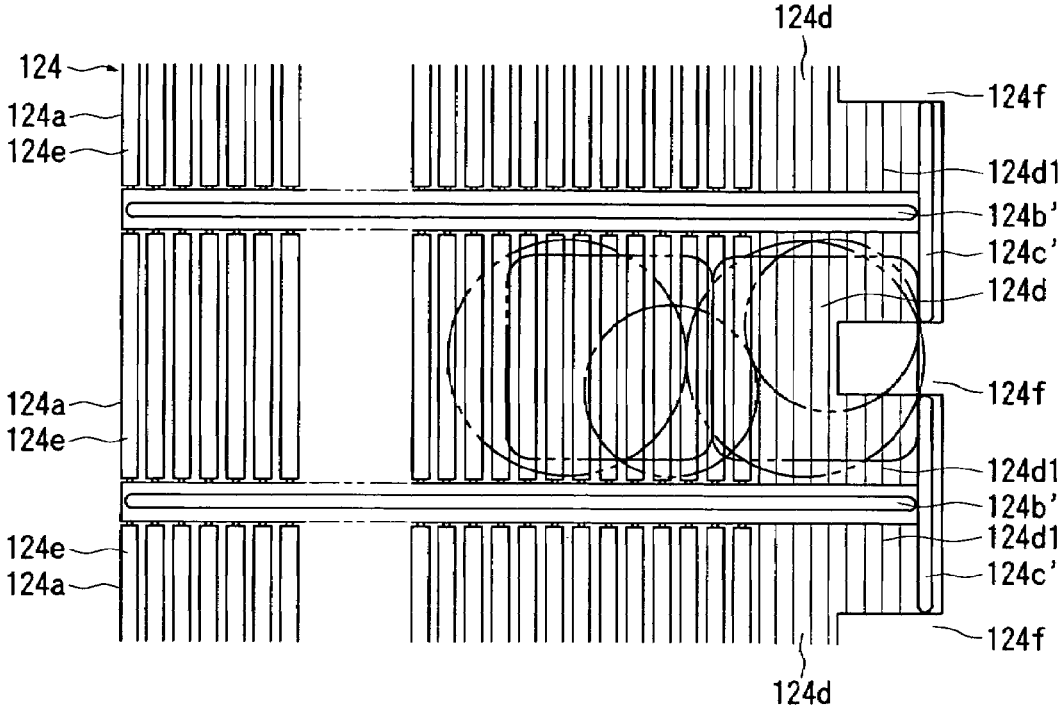
FIG. 19 is a top view showing a modified embodiment of the storing tray.

The guide portion 124*b*, and the stopper portion 124*c* are not necessarily wall-shaped, and as shown in FIG. 19, the guide portion 124*b*' and the stopper portion 124*c* ' may be constituted by a linear member such as a wire and the like disposed along each upper end edge. Further, the portion constituted by the roller 124*e* of the bottom surfaces may be constituted by a metal plate, a plastic plate and the like small in skin friction resistance.

In the event that the commodity is stored in the storing portion 124*a* of the storing tray 124, the operation for loading the commodities in order in an upright state on the front end portion of the bottom surface of may be repeated. Since the bottom surface is inclined downward from the front to the rear, the commodity loaded in an upright state slides on the roller 124*e* and moves toward the taking-out portion 124*d* while remaining in an upright state, and as shown in FIGS. 18 and 19, after gaining entry to the taking-out portion 124*d*, abuts against the stopper portion 124*c* and stops.

Note that the cooling down of the commodities stored in the storing portion 124*a* of each storing tray 124 can be performed by circulating the air cooled by the evaporator of a refrigeration unit inside the chamber 101*a* or by guiding the air cooled by the evaporator to the interior side of each room through a duct or by laying an evaporative pipe in each room. Further, the warming of the commodities stored in the storing portion 124*a* of each storing tray 124 can be performed by disposing a hot plate on the downside of the roller 124*e* and the taking-out portion 124*d*. Of course, it does not matter if the cooling or the warming of the commodities stored in each storing portion 124*a* is performed by using other cooling methods or warming methods.

Figure 20:
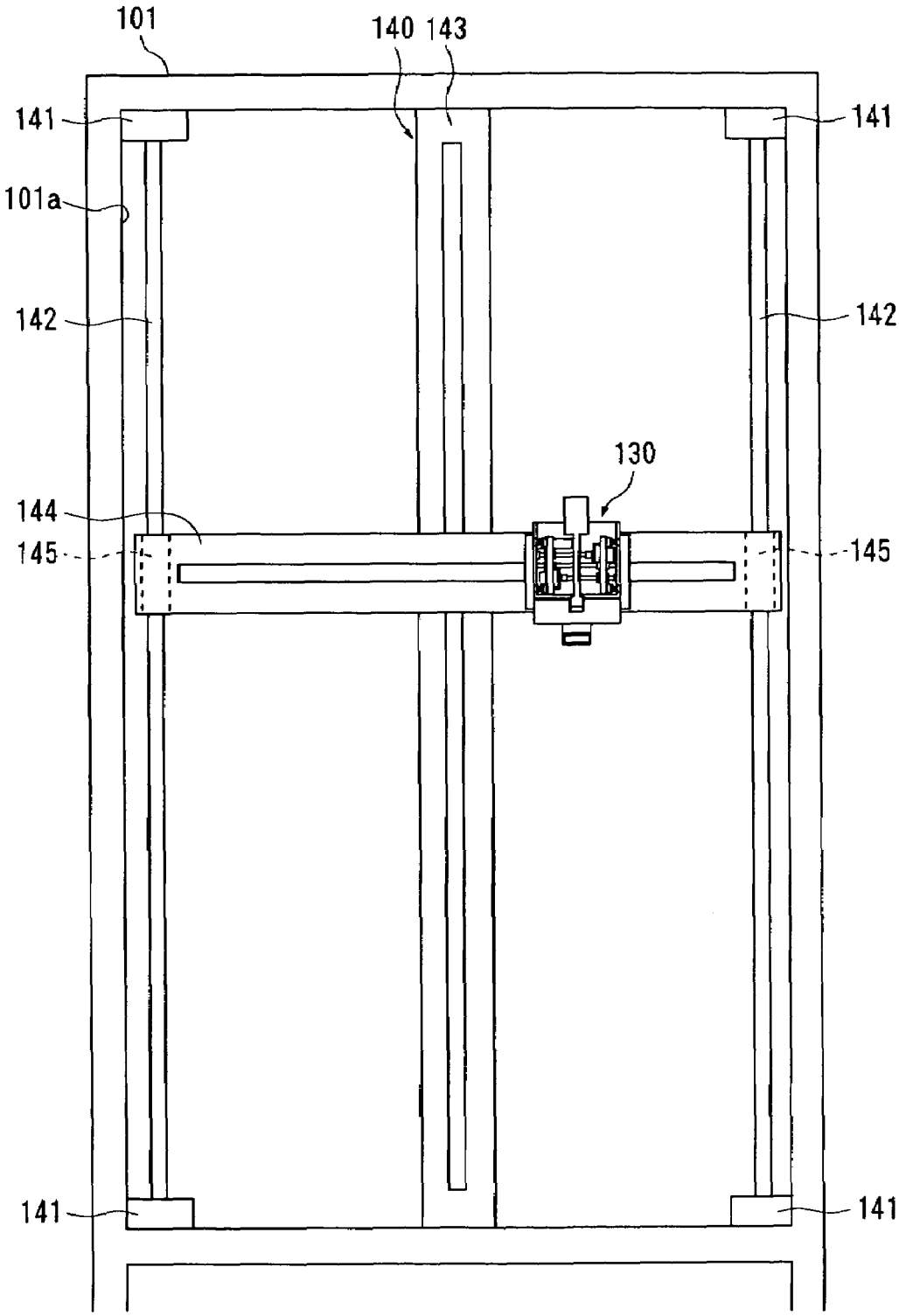
FIG. 20 is a front view of a hand unit and its movement mechanism.
Figure 21:
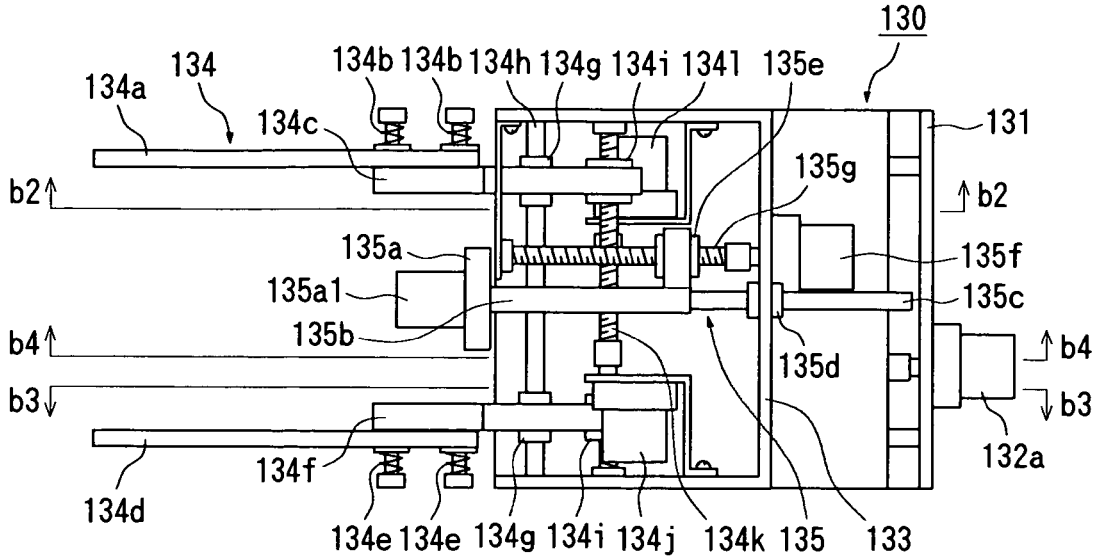
FIG. 21 is a top view of the hand unit shown in FIG. 20.
Figure 22:
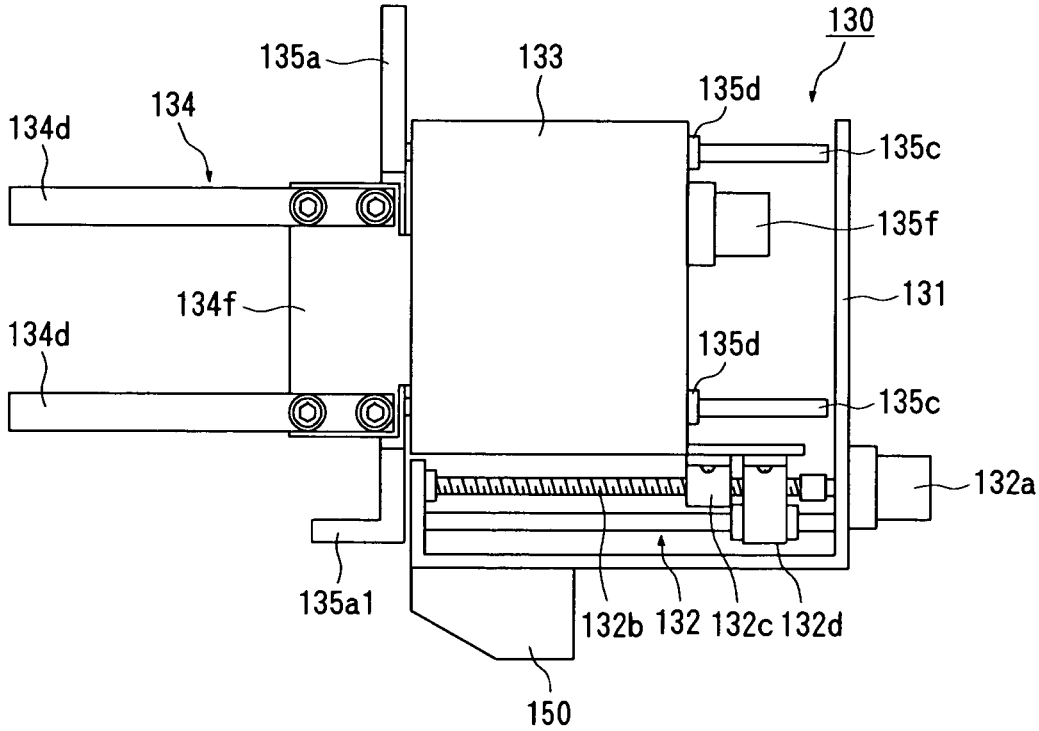
FIG. 22 is a right side view of the hand unit shown in FIG. 20.
Figure 23:
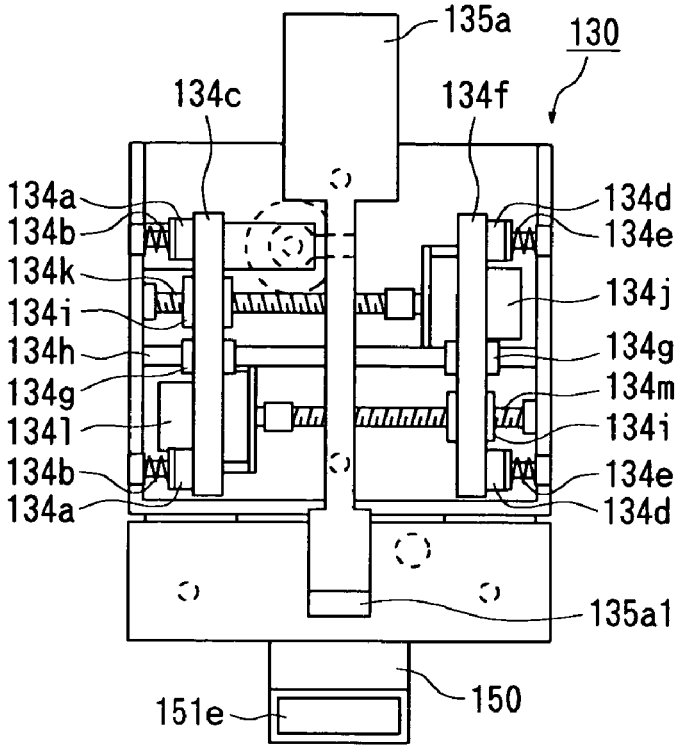
FIG. 23 is a front view of the hand unit shown in FIG. 20.
Figure 24:
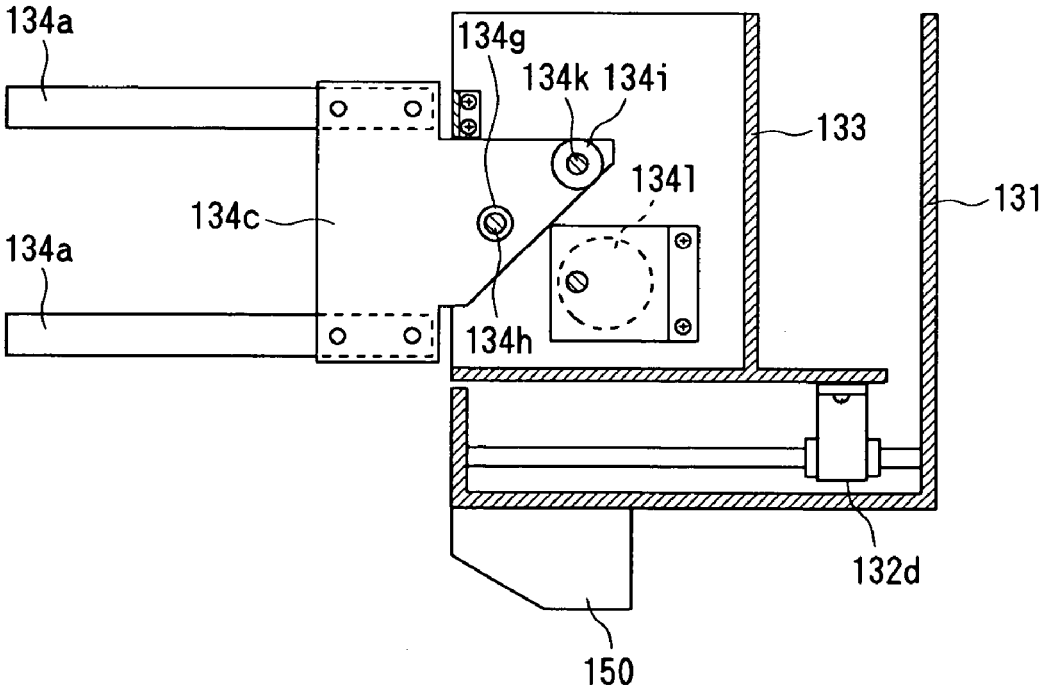
FIG. 24 is a view cut in a line b2—b2 in FIG. 21.
Figure 25:
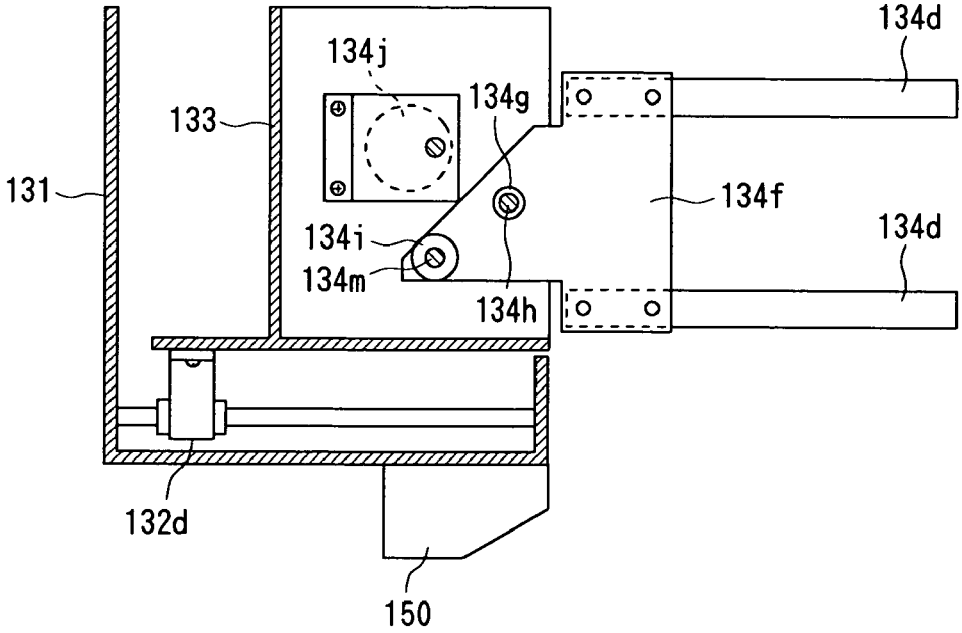
FIG. 25 is a view cut in a line b3—b3 in FIG. 21.
Figure 26:
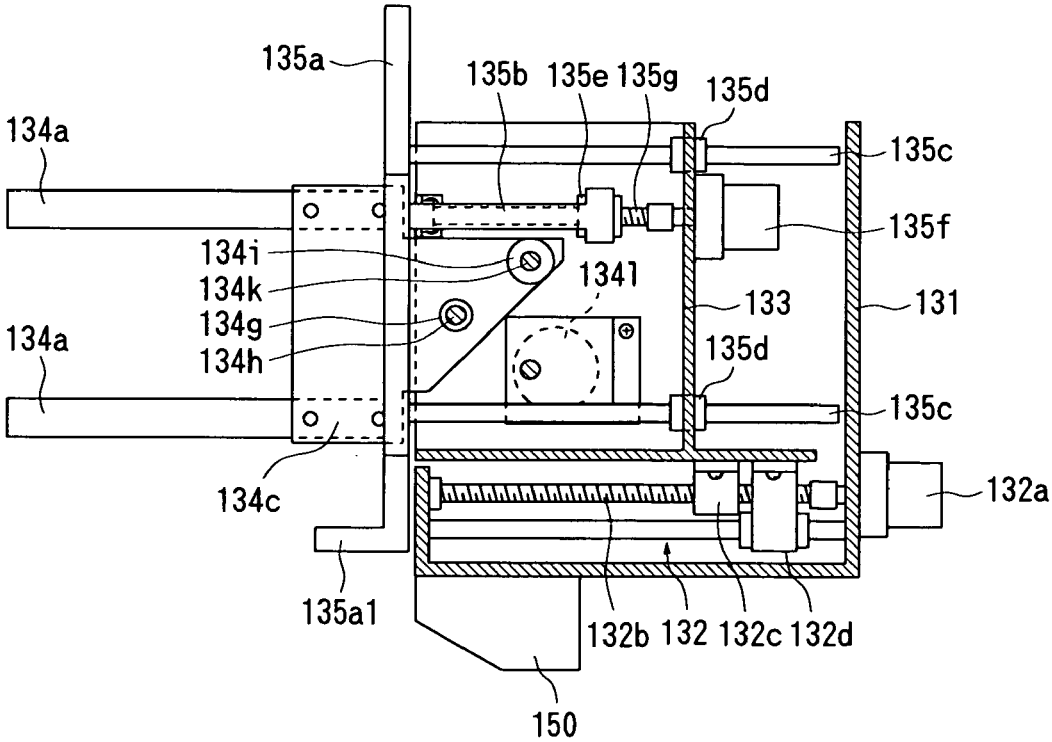
FIG. 26 is a view cut in a line b4—b4 in FIG. 21.

FIG. 20 shows a front view of a hand unit and its movement mechanism provided at the rear of the rooms SR101 to SR106 shown in FIG. 17. Further, FIG. 21 shows a top view of the hand unit shown in FIG. 20, and FIG. 22 shows a right surface of the hand unit shown in FIG. 20. The FIG. 23 shows a front view of the hand unit shown in FIG. 20. FIG. 24 shows a view cut in a line b2—b2 in FIG. 21, and FIG. 25 shows a view cut in a line b3—b3 in FIG. 21, and FIG. 26 shows a view cut in a line b4—b4 in FIG. 21.

The hand unit 130 comprises a left-and-right slider 131, a back-and forth slider drive mechanism 132 provided on the left-and-right slider 131, a back-and-forth slider 133, a hand mechanism 134 provided on the back-and-forth slider 133, and a bearing mechanism 135 provided on the back-and-forth slider 133. That is, this hand unit 130 is constituted by including the left-and-right slider 46, the back-and-forth slider 47 and its drive mechanism in the first embodiment, and the hand mechanism 134 and the bearing mechanism 135 provided on the back-and-forth slider 133 can be moved up and down, left and right, and back-and-forth by the back-and-forth slider 133, the back-and-forth drive mechanism 132 and the movement mechanism 140 to be described later.

The back-and-forth slider drive mechanism 132 comprises a motor 132*a*, a ball screw 132*b* connected to a rotational shaft of the motor 132*a*, a nut 132*c* screwed to the ball screw 132*b*, and guide means 132*d* for controlling a linear movement of the nut 132*c*, and the nut 132*c* is connected to the back-and-forth slider 133.

The hand mechanism 134 comprises two right fingers 134*a* composed of long sideways rectangular plates, a right support member 134*c* for supporting the base of each finger 134*a* under the energization of a spring 134*b*, two left fingers 134*d* composed of the long sideways rectangular plates disposed so as to come to face to face with two right fingers 134*a*, and a left support member 134*f* for supporting the base of each left finger 134*d* under the energization of a spring 134*e*.

Further, in the right support member 134*c* and the left support member 134*f*, there are provided bushes 134*g*, respectively, and a common guide rod 134*h* mounted inside the back-and-force slider 133 is inserted into each bush 134*g*. Furthermore, in the right support member 134*c* and the left support member 134*f*, there are provided nuts 134*i*, respectively. The nut 134*i* of the right support member 134*c* is screwed into a ball screw 134*k* connected to a right finger motor 134*j* provided inside the back-and-forth slider 133, while the nut 134*i* of the left support member 134*f* is screwed into a ball screw 134*m* connected to a right finger motor 134*l* provided inside the back-and-forth slider 133.

That is, in this hand mechanism 134, two pieces of right finger 134*a* are moved left and right by the right finger motor 134*j*, and two pieces of left finger 134*d* are moved left and right by the left finger motor 134*l*, thereby opening and closing both fingers 134*a* and 134*d*. The clearance CL (see FIG. 32) between the left and the right when both the fingers 134*a* and 134*d* spread to the fullest extent are set slightly larger than the maximum diameter and the maximum width of the commodity storable in each storing portion 124*a*.

Further, since two pieces of pin (reference numeral not available) provided in the right support member 134*c* are inserted into two holes (reference numeral not available) provided in the base portion of each right finger 134*a*, and two pieces of pin (reference numeral not available) provided in the left supporting portion member 134*f* are inserted into two holes (reference numeral not available) provided in the base portion of each left finger 134*d*, each finger 134*a* and 134*d* can make a parallel displacement so as to separate outside from each support member 134*c* and 134*f* when a force exceeding the energizing force of the springs 134*b* and 134*e* acts externally. Incidentally, the energizing force in case of gripping the commodities (C1 to C18) is desirable to be about 2 kg/cm$^2$.

While it is a matter of course to use a mechanism capable of exerting a gripping force sufficient enough to perform the taking-out and the movement of the commodities to be described later as the hand mechanism 134, it is desirable to provide an anti-slip agent composed of a synthetic rubber, a flexible plastic and the like in the interior surface of each finger 134*a* and 134*d*.

The bearing mechanism 135 comprises a bearing member 135*a* with the bottom portion projected in the front and the shape of almost a L letter, and a support member 135*b* connected to the bearing member 135*a*.

Further, in the support members 135*b*, there are provided two guide rods 135*c*, and respective guide rods 135*c* are inserted into two bushes 135*d* provided at the rear surface of the back-and-force slider 133. Further, on the support member 135*b*, there is provided a nut 135*e*, and this nut 135*e* is screwed into a ball screw 135*g* connected to a motor 135*f* provided in the rear surface of the back-and-forth slider 133.

That is, in this bearing mechanism 135, the bearing member 135*a* can be moved back and force by the motor 135*f*.

The movement mechanism 140 is constituted by a pair of left and right guide rods 142 provided between up and down fixing tools 141, an up-and-down drive unit 143 built-in with an up-and-down drive mechanism (illustration omitted), an up-and-down slider 144, a left-and-right slider drive mechanism (illustration omitted) provided inside the up-and-down slider 144.

The up-and-down slider drive mechanism comprises a motor 143*a* (see FIG. 28), a ball screw (illustration omitted) connected to the rotational shaft of the motor 143*a*, a nut (illustration omitted) screwed into the ball screw, and guide means (illustration omitted) for controlling a linear movement of the nut, and the exposed portion of the nut is connected to the up-and-down slider 144. On both the left and right end portions of this up-and-down slider 144, there are provided bushes 145, and the guide rods 142 are inserted into the bushes 145.

The left-and-right slider drive mechanism comprises a motor 144*a* (se FIG. 28), a nut (illustration omitted) screwed into a ball screw, and guide means (illustration omitted) for controlling the linear movement of the nut. The exposed portion of the nut is connected to the left-and-right slider 131.

Figure 27A:
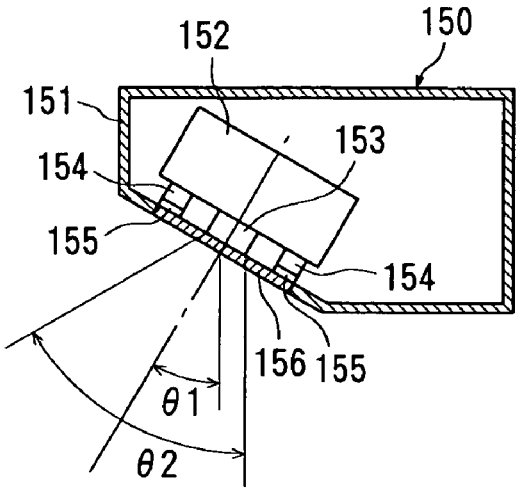
FIG. 27A is a longitudinal section of a camera.
Figure 27B:
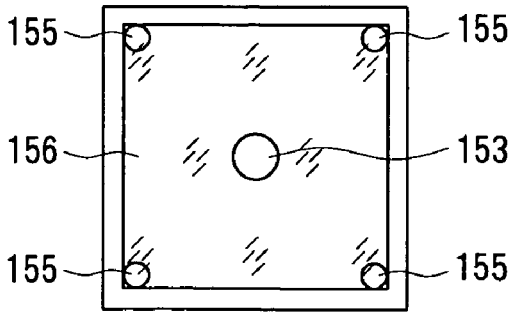
FIG. 27B is a front view of a transparent plate of the camera.

Further, on the left-and-right slider 131, there is provided imaging means for imaging the commodity located in the taking-out portion 124*d* of the storing portion 124*a* of the storing tray 124 and obtaining an image data thereof, specifically as shown in FIGS. 27A and 27B, a color or monochrome camera 150 comprising a case 151, an imaging element 152 such as a CMOS sensor, a CCD sensor and the like, a circuit (illustration omitted) for imaging and outputting imaging signals based on an external command, an optical system 153, four pieces of illuminating white LED 154 disposed around the optical system 153, a light diffusion filter 155 provided in the front end of each LED 154, and a transparent plate 156 such as a glass and the like disposed in the front end of the optical system 153 and the light diffusion filter 155.

Incidentally, an angle θ1 made by an optical axis and a vertical line of the camera 150 is about 30 degrees, and an image angle θ2 of the camera 150 is about 50 to 60 degrees. Further, the camera 150 is hermitically constituted so that foreign materials, humidity and the like do not intrude, and antiseptic is disposed inside if need arises.

The image data obtained by this camera 150 is used for information when the up and down position and the left and the right position of the hand unit 130 are corrected before the commodity located at the taking-out portion 124*d* of the storing portion 124*a* of the predetermined storing tray 124 is gripped by the left and right fingers 134*a* and 134*d* of the hand mechanism 134.

Figure 28:
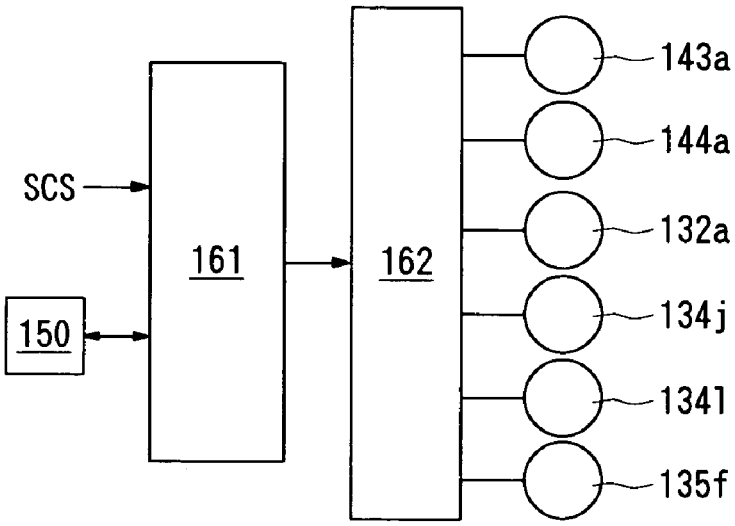
FIG. 28 is a block diagram showing a control system according to a taking-out and a movement of a commodity.

FIG. 28 shows a control system according to a taking-out and a movement of the commodity.

This control system comprises a control circuit 161 of a microcomputer constitution, and a drive circuit 162 for sending a drive signal to each motor 132*a*, 134*j*, 134*l* and 135*f* of the hand and each motor 143*a* and 144*a* of the movement mechanism 140 based on a control signal from the control circuit 161.

While it is preferable to use a pulse motor or a servo motor easy for a position control for the motors 132*a*, 134*j*, 134*l*, 135*f*, 143*a* and 144*a*, it is possible also to use an ordinary DC motor easy for a torque control for the motors 134*j* and 134*l*, for opening and closing the left and right fingers 134*a* and 134*d*. Further, the control circuit 161 is connected to the camera 150 through an interface, and is connected to an input line of a vending command signal SCS.

Hereinafter, the operation of the taking-out and the movement of the commodity in the above-described vending machine will be described with reference to FIGS. 29 to 42.

On the occasion of purchasing the commodity, when a purchaser throws a predetermined amount through the coin slot 110 and the bill slot 113, and pushes the commodity selection button 107, the vending command signal SCS corresponding to the selected commodity is inputted to the control circuit 161 from the control system (illustration omitted) according to the vendition of the commodity. This vending command signal SCS includes information for specifying the storing portion 124*a* of the storing tray 124 storing the selected commodity from among a plurality of storing portions 124*a* of the storing tray 124.

Figure 29:
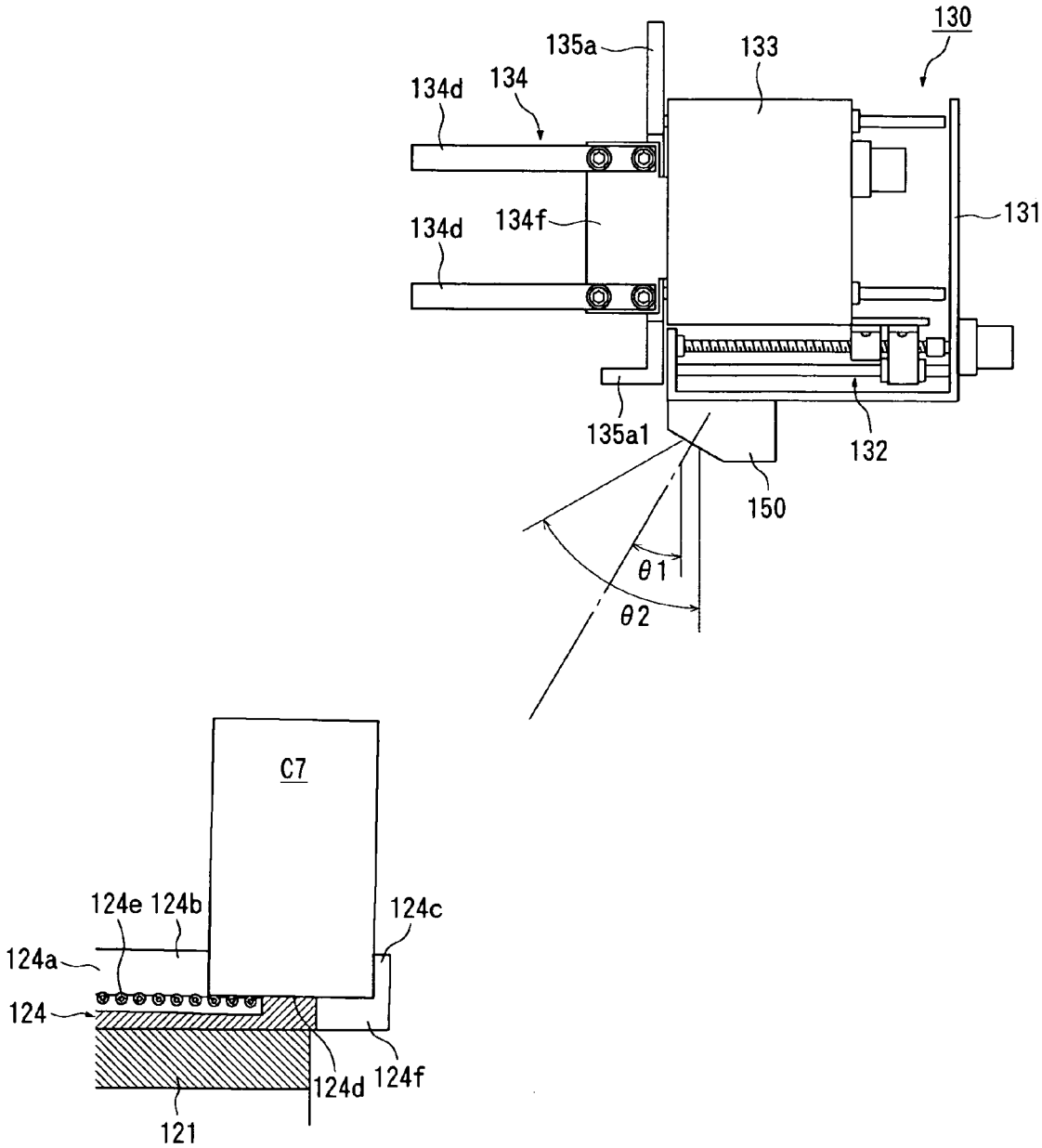
FIG. 29 is an explanatory view of an operation according to the taking-out and the movement of the commodity.
Figure 30A:
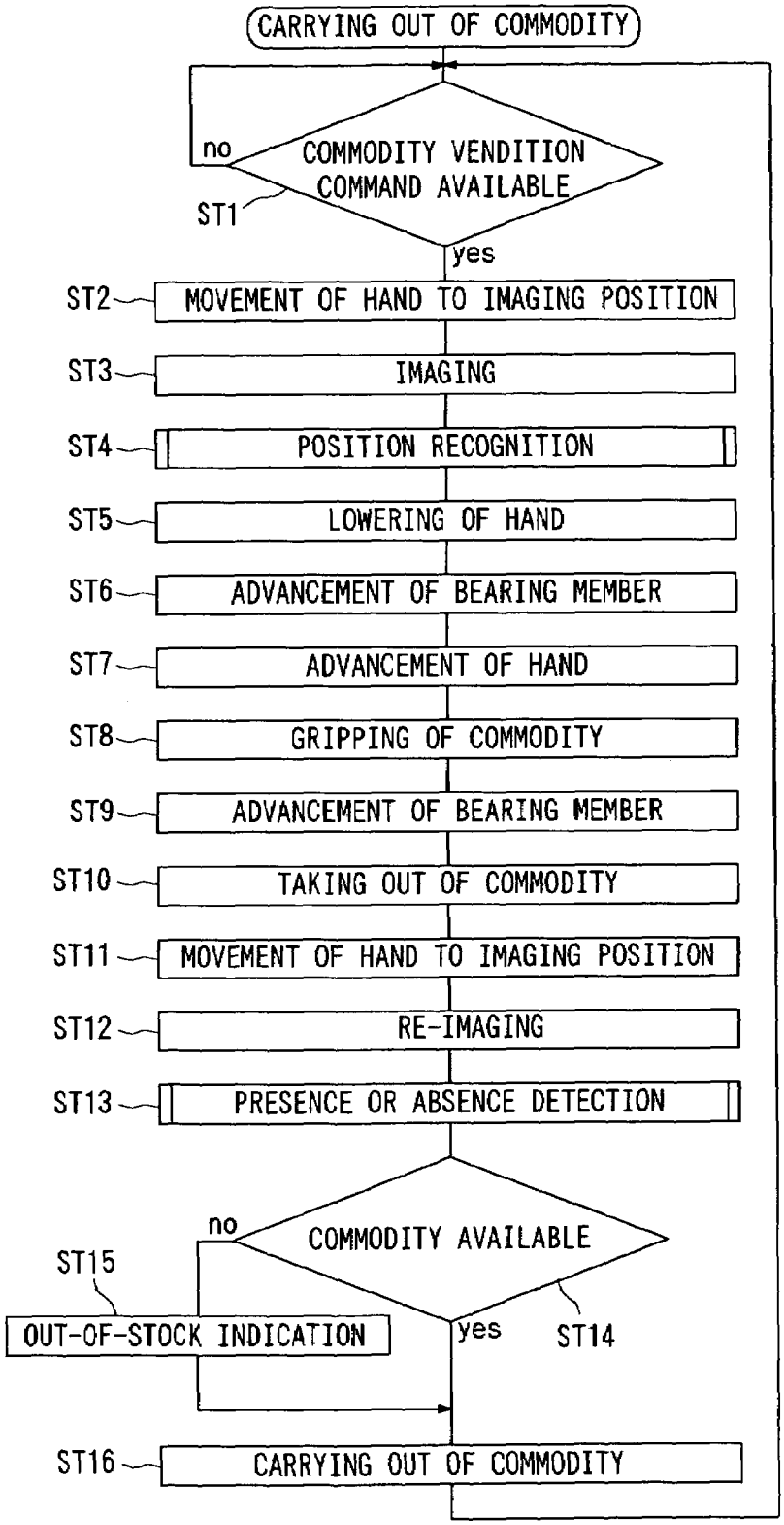
FIG. 30A is a flowchart according to a carrying out of the commodity.

For example, in the case where the vending command signal SCS corresponding to the commodity C7 is inputted to the control circuit 161 (step ST1 of FIG. 30A), as shown in FIG. 29, the motor 143*a* of the up-and-down slider drive mechanism and the motor 144*a* of the left-and-right slider drive mechanism are allowed to operate so as to move the up-and-down slider 144 and the left-and-right slider 131, and the hand unit 130 located at a waiting position is moved to a position capable of imaging obliquely from above by its camera 150 the taking-out portion 124*d* of the storing portion 124*a* of the storing tray 124 storing the commodity C7 and the under portion of the commodity C7 located in the taking-out portion 124*d*, and is stopped (step ST2 of FIG. 30A).

Since the data of the vertical plane coordinate and the horizontal plane coordinate of the taking-out portion 124*d* of each storing portion 124*a* can be known in advance by the position of the each storing portion 124*a* and the length of a rear protrusion of the taking-out portion 124*d*, the movement of the hand unit 130 can be appropriately performed when the vending command signal SCS corresponding to the commodity C7 and other commodities is inputted.

Figure 30B:
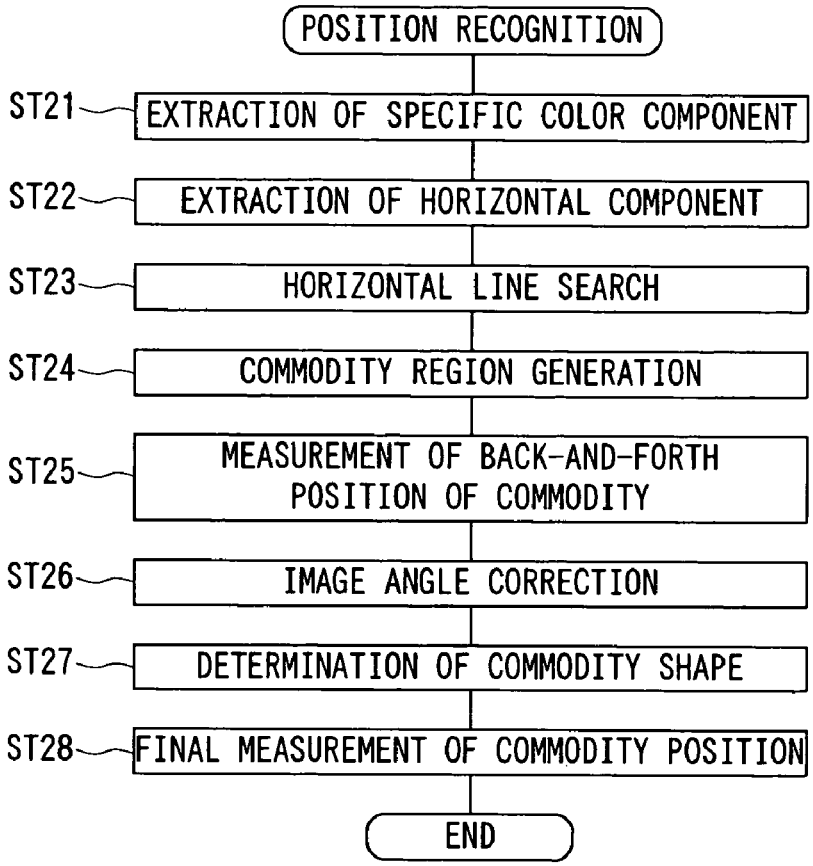
FIG. 30B is a flowchart according to a position recognition of FIG. 30A.

Next, the image of the taking-out portion 124*d* of the storing portion 124*a* and the under part of the commodity C7 located at the taking-out portion 124*d* are took in by the camera 150 (step ST3 of FIG. 30A), and the processing for the position recognition shown in FIG. 30B is performed (step ST4 of FIG. 30A).

Figure 31:
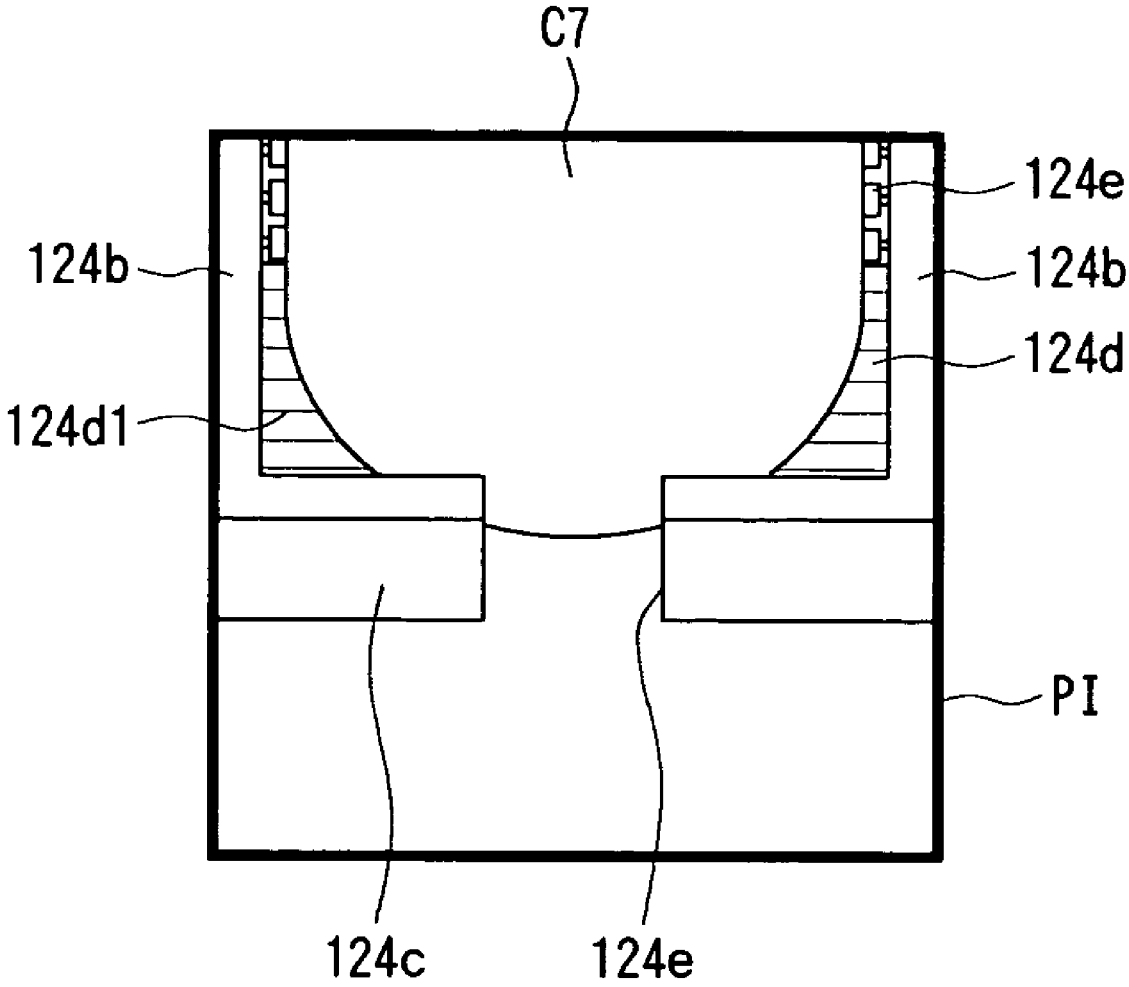
FIG. 31 is a view showing an image obtained by the camera.

With respect to the processing for the position recognition of step ST4, first, the processing for extracting a color component necessary for a later processing from a image PI obtained from an imaging as shown in FIG. 31 is performed (step ST21 of FIG. 30B). Next, the processing for enhancing horizontal lines appeared according to the roller 124*e* of the storing portion 124*a* and the horizontal line pattern 124*d* l provided in the taking-out portion 124*d* included in the image PI is performed (step ST22 of FIG. 30B). Next, the processing for searching the horizontal lines from the left and right of the image and finding last stop points (intersection point with the commodity C7) of the horizontal lines is performed (step ST23 of FIG. 30B). Next, the processing for obtaining the contour of the commodity C7 from the last stop points is performed (step ST24 of FIG. 30B). Next, the processing for obtaining the back-and forth position of the commodity C7 from the lower end of the commodity contour is performed (step ST25 of FIG. 30B). Next, the processing for correcting a distortion of the commodity contour based on an image angle from the back-and-forth position of the commodity C7 is performed (step ST26 of FIG. 30B ). Next, the processing for determining a shape and an aspect of the commodity C7 from the commodity contour after correcting the distortion is performed (step ST27 of FIG. 30B). Then, the processing for deciding the left-and-right position and the back-and-forth position of the commodity C7 and the left-and-right position of the notch 124*f* is performed (step ST28 of FIG. 30B).

The reason why the commodity C7 located at the taking-out portion 124*d* of the storing portion 124*a* is imaged obliquely from above by the camera 150 is because (1) the recognition of the shape and the back-and-forth position can be accurately made even in the case that the commodity is transparent, (2) a focal distance can be secured even if the distance between the camera and the commodity is close to each other, and (3) it is hard to be affected by a reflected light from the commodity and the like. Nevertheless, even if the position recognition according to the procedure excepting step ST21 and ST22 from among the processing steps of the position recognition as shown in FIG. 30B is performed, the desired Position recognition is fully possible. Of course, it does not matter even if the position recognition is performed by the procedure other than the above described.

Further, it is possible to perform the imaging in step ST3 by moving the camera 150 to a position squarely opposite to the commodity C7 located at the taking-out portion 124*d* of the storing portion 124*a*. In this case, it is desirable to adopt a stopper 124*c*' in the shape of a wire such as shown in FIG. 19 so that the under part of the commodity C7 is not concealed from the wall-shaped stopper portion 124*c*.

Figure 32:
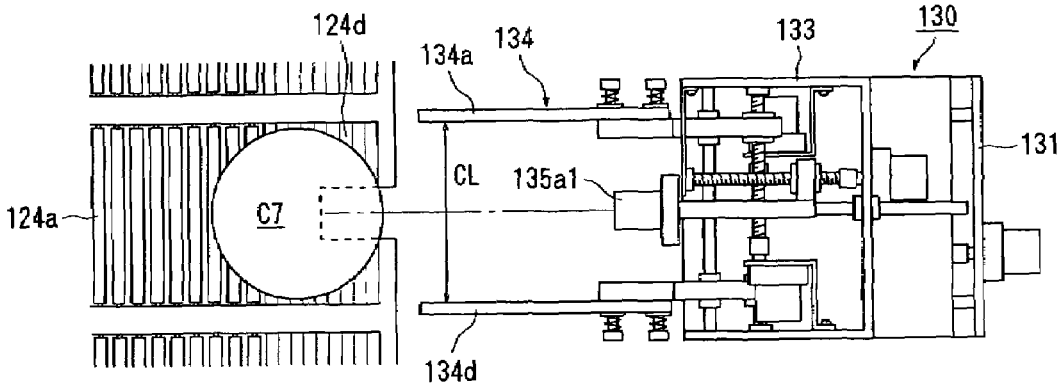
FIG. 32 is an explanatory view of the operation according to the taking-out and the movement of the commodity.

Next, as shown in FIG. 32, the motor 143*a* of the up-and-down slider drive mechanism and the motor 144*a* of the left-and-right slider drive mechanism are operated so as to move the up-and-down slider 144 and the left-and right slider 131, so that the lower end projection portion 135*a* l of the bearing member 135*a* of the hand unit 130 is matched in the center line to the notch 124*f* of the storing portion 124*a* in center line, and furthermore, the top surface of the lower end projection portion 135*a* 1 of the bearing member 135*a* is allowed to descend to a position slightly lower than the upper surface of the taking-out portion 124*d* of the storing portion 124*a*, and is stopped (step ST5 of FIG. 30A).

Figure 33:
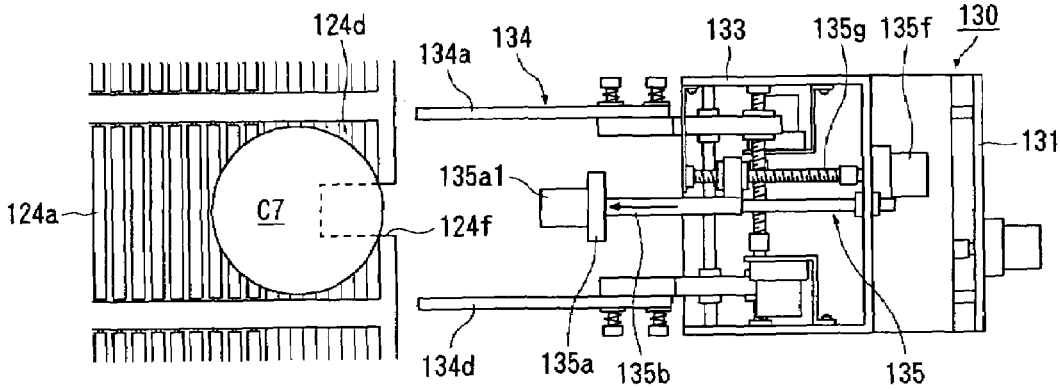
FIG. 33 is an explanatory view of the operation according to the taking-out and the movement of the commodity.

Next, as shown in FIG. 33, the motor 135*f* of the bearing mechanism 135 is operated so as to advance the bearing member 135*a* from the retreated position (step ST6 of FIG. 30A).

Figure 34:
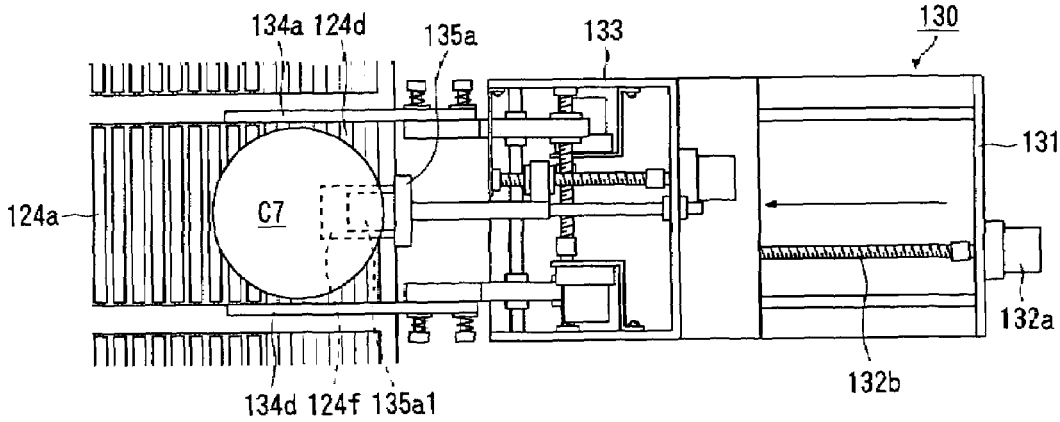
FIG. 34 is an explanatory view of the operation according to the taking-out and the movement of the commodity.

Next, as shown in FIG. 34, the motor 132*a* of the back-and-forth slider drive mechanism 132 is operated so as to advance the back-and-forth slider 133 from the retreated position, and the lower end projection portion 135*a* 1 of the bearing member 135*a* is inserted into the notch 124*f* of the storing portion 124*a*, and at the same time, the right fingers 134*a* and the left fingers 134*d* are inserted into the outside of the commodity C7 (step ST7 of FIG. 30A). The clearance CL between the left and the right of both the fingers 134*a* and 134*d* at this time is in a state of spreading to the fullest extent, and furthermore, since the clearance between the left and the right is slightly larger than the bottom surface width of the storing portion 124*a*, regardless of the size, shape and aspect of the commodity, the right finger 134*a* and the left finger 134*d* are prevented from interfering with the commodity when they are inserted.

Figure 35:
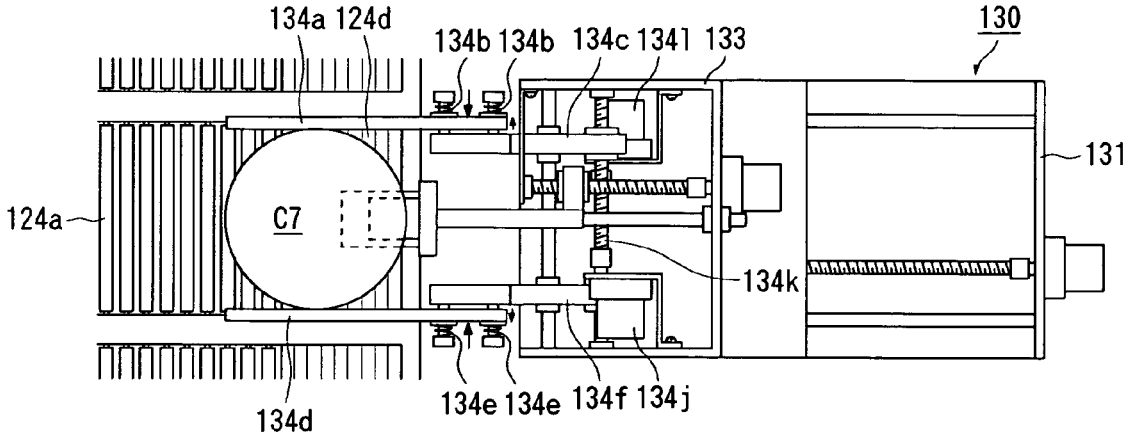
FIG. 35 is an explanatory view of the operation according to the taking-out and the movement of the commodity.
Figure 36:
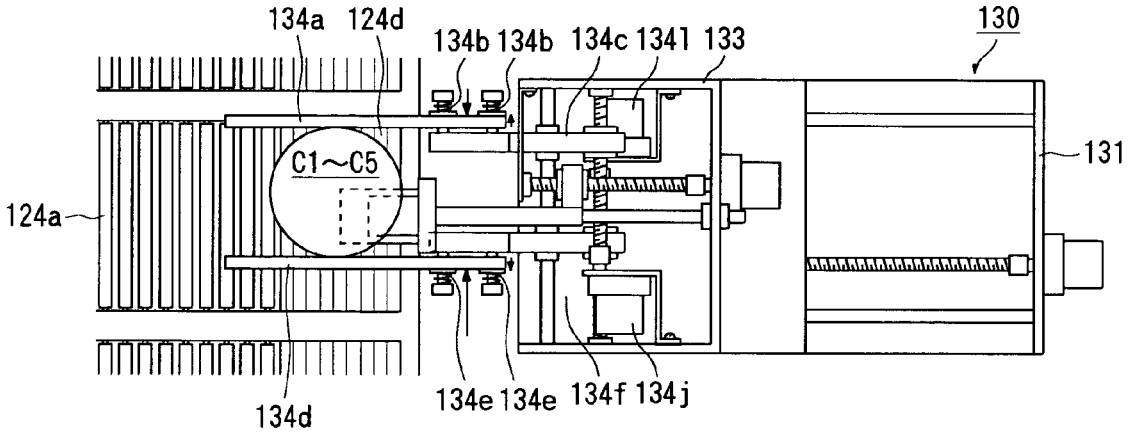
FIG. 36 is an explanatory view of the operation according to the taking-out and the movement of the commodity.
Figure 37:
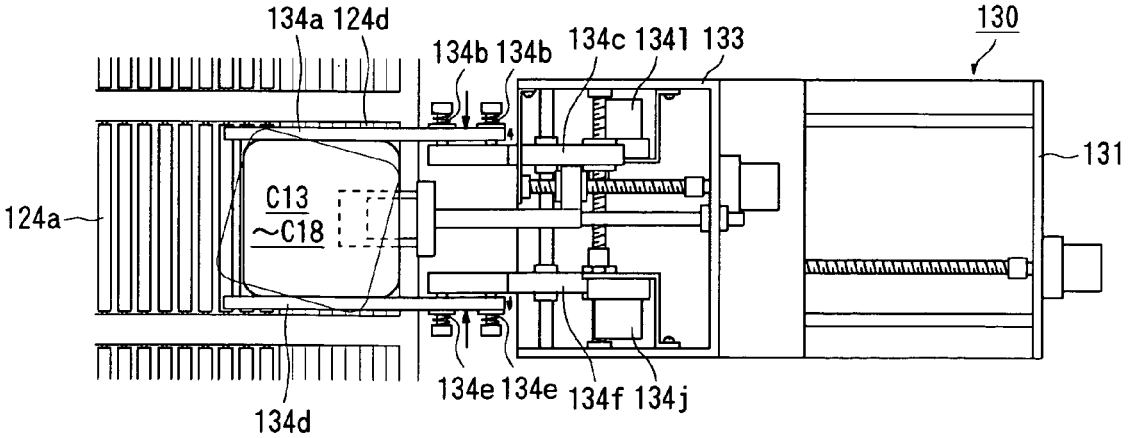
FIG. 37 is an explanatory view of the operation according to the taking-out and the movement of the commodity.

Next, as shown in FIGS. 35 to 37, a right finger motor 134*j* and a left finger motor 134*l* of the hand mechanism 134 are operated, so that both the fingers 134*a* and 134*d* are closed to hold the commodity C7 and grip the commodity (step ST8 of FIG. 30A).

In the event that the commodity is gripped by closing both the fingers 134*a* and 134*d*, information regarding the left and right position of the commodity C7 obtained by the image recognition is used, and a moving distance of the right finger 134*a* and the left finger 134*d* is changed so that the commodity located at the taking-out portion 124*d* does not move left and right.

Similarly with the commodity C7, commodity C6, and commodities C8 to C18, when the commodity C7 (commodity C6, and commodities C8 to C18) approximated to the left and right size of the bottom surface of the storing portion 124*a* in diameter or the under surface shape is located approximately in the center of the taking-out potion 124*d* as shown in FIG. 35, the right fingers 134*a* and the left fingers 134*d* are moved inward to an equal distance so as to perform the gripping of the commodity.

Similarly with the commodities C1 to C5 having the diameter or the under surface shape thereof smaller than the left and right size of the bottom surface of the storing portion 124*a*, when the commodities C1 to C5 lean to either of the left or the right of the taking-out portion 124*d* as shown in FIG. 36, a moving distance of the right fingers 134*a* and the left fingers 134*d* are changed according to the position thereof so as to perform the gripping of the commodity. In FIG. 36, since the commodities C1 to C5 lean to the right of the storing portion 124*d*, in this case, the left fingers 134*d* rather than the right fingers 134*a* is greatly moved, thereby preventing the commodities C1 to C5 from moving left and right.

A gripping method in case of the under surface shape being rectangular or approximated to a rectangular shape similarly with the pet-bottled beverage (C13 to C18) is the same as described above. Further, in case of the pet-bottled beverage, as shown in FIG. 37, though there are sometimes the cases where the aspect of the beverage is disturbed in the taking-out portion 124*d*, even at such a time, it is possible to correct the aspect of the commodity in the course of closing the right finger 134*a* and the left finger 134*d*.

Further, in the event that both the fingers 134*a* and 134*d* are moved inward to grip the commodity (C1 to C18), the left and right clearance between both the fingers 134*a* and 134*d* is made smaller than the diameter or the width of the commodity by about 3 to 5 mm. As described earlier, since both the fingers 134*a* and 134*d* are attached to each support member 134*c* and 134*f* in a state of being biased inward by springs 134*b* and 134*e*, if moved in this way, both the fingers 134*a* and 134*d* move in parallel as if to escape against biasing force of the springs 134*b* and 134*e* outward approximately by the same distance from each support member 134*c* and 134*f* after brought into contact with the commodity. That is, since a force by which the commodities (C1 to C18) are gripped by both the fingers 134*a* and 134*d* becomes equivalent to a biasing force of the springs 134*b* and 134*e*, for example, if the biasing force of the springs 134*b* and 134*e* is set to 2 kg/cm$^2$, regardless of the shape and aspect of the commodity, it is possible to grip all the commodities by the force of about 2 kg/cm$^2$.

Figure 38:
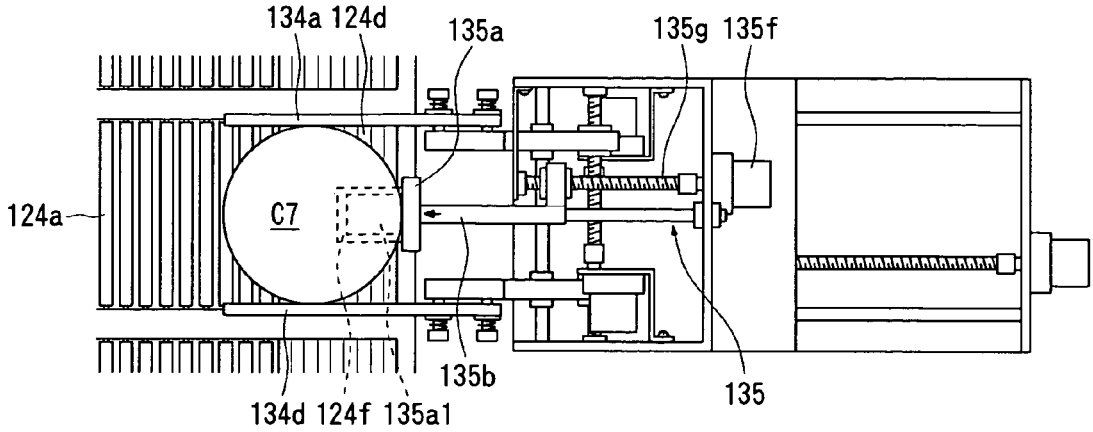
FIG. 38 is an explanatory view of the operation according to the taking-out and the movement of the commodity.
Figure 39:
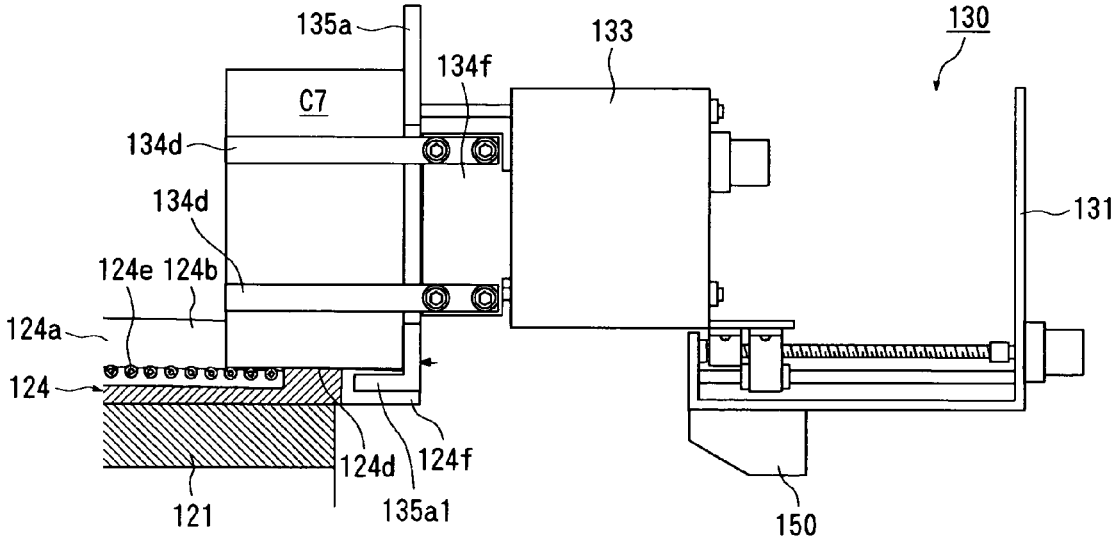
FIG. 39 is an explanatory view of the operation according to the taking-out and the movement of the commodity.

Next, as shown in FIGS. 38 and 39, the motor 135*f* of the bearing mechanism 135 is operated so as to advance the bearing member 135*a* to a position in which its front surface abuts against the commodity, and the posture of the commodity C7 gripped by both the fingers 134*a* and 134*d* is corrected (step ST9 of FIG. 30A).

Figure 40:
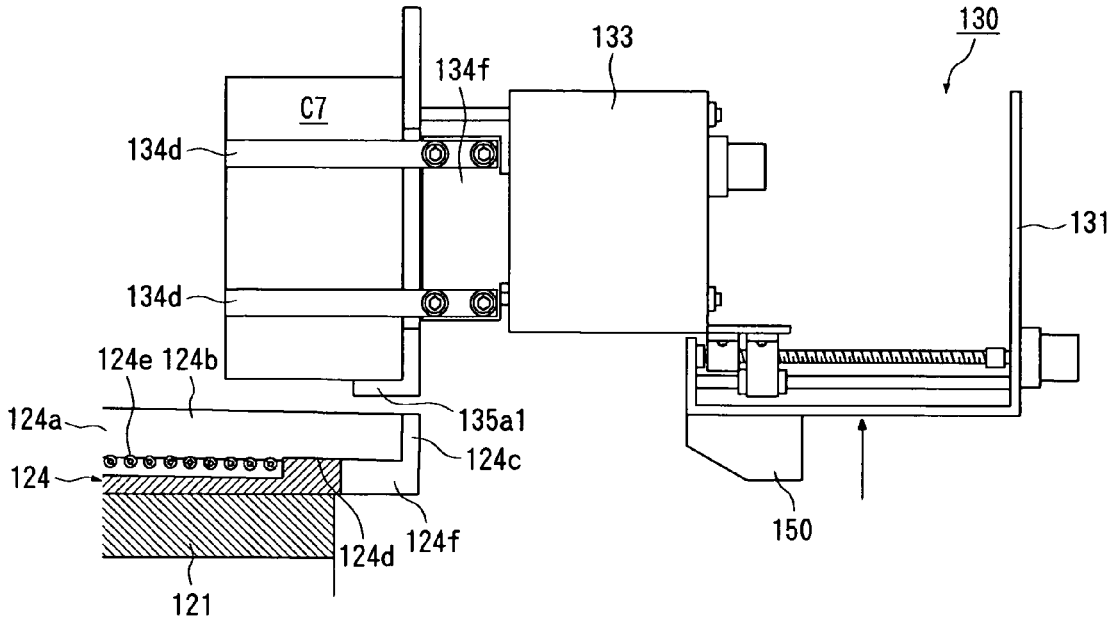
FIG. 40 is an explanatory view of the operation according to the taking-out and the movement of the commodity.
Figure 41:
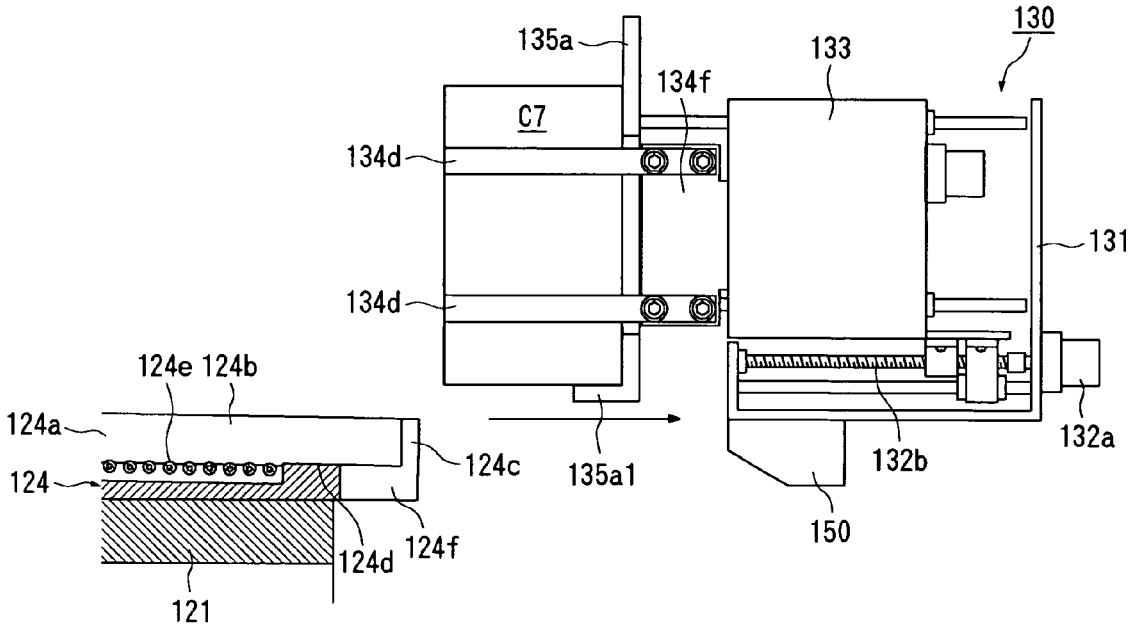
FIG. 41 is an explanatory view of the operation according to the taking-out and the movement of the commodity.

Next, as shown in FIG. 40, the motor 143*a* of the up-and-down slider drive mechanism is operated so as to lift the up-and-down slider 144, and the commodity C7 gripped by both the fingers 134*a* and 134*d* is lifted to a position climbing over the stopper portion 124*c*, and is extracted. Subsequently, as shown in FIG. 41, the motor 132*a* of the back-and-force slider drive mechanism 132 is operated so as to allow the back-and-forth slider 133 to retreat from the advanced position, thereby performing the taking-out of the commodity (step ST10 of FIG. 30A).

Next, the motor 143*a* of the up-and-down drive mechanism and the motor 144*a* of the left-and-right slider drive mechanism are operated so as to move the up-and-down slider 144 and the left-and-right slider 131, thereby restoring the hand unit 130 to the imaging position (step ST11 of FIG. 30A).

Figure 30C:
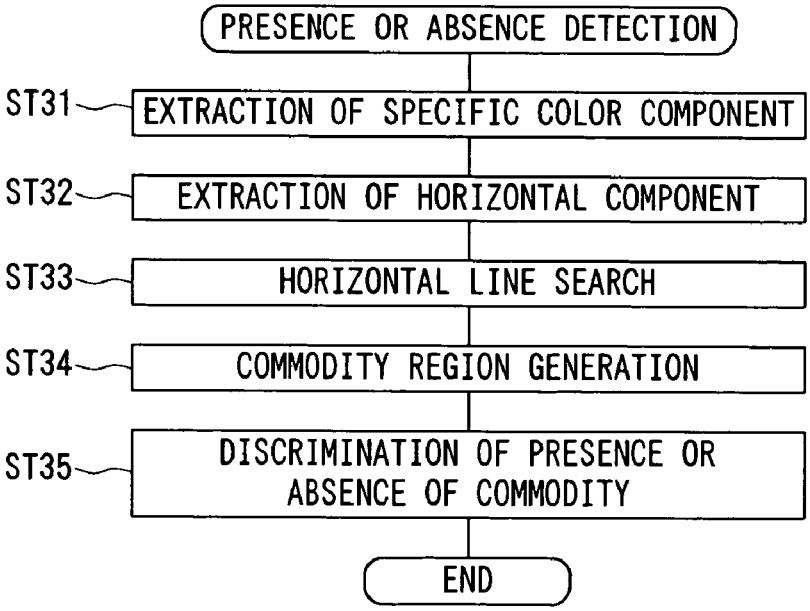
FIG. 30C is a flowchart according to a presence or absence detection of FIG. 30A.

Next, the same imaging as described above is performed again by the camera 150 (step ST12 of FIG. 30A), and the processing for the presence or absence detection as shown in FIG. 30C is performed (step ST13 of FIG. 30A).

The processing for the presence or absence detection of step ST13 performs an extracting processing of the color component necessary for a later processing from the image PI as shown in FIG. 31 and obtained from the imaging (step ST31 of FIG. 30C). Next, the processing for enhancing horizontal lines appeared according to the roller 124*e* of the storing portion 124*a* and the horizontal pattern 124*d* 1 provided in the taking-out portion 124*d* included in the image PI is performed (step ST32 of FIG. 30C). Next, the processing for searching the horizontal lines from the left and the right of the image and finding last stop points (intersection point with the commodity C7) of the horizontal lines is performed (step ST33 of FIG. 30C). Next, the processing for obtaining the contour of the commodity C7 from the last stop points is performed (step ST34 of FIG. 30C). Next, the processing for determining the presence or absence of the commodity based on whether or not the contour of the commodity C7 is obtained (step ST35 of FIG. 30C).

Similarly with the processing of the position recognition described with reference to FIG. 30B, even when the procedure for the presence or absence detection excepting the processing steps ST31 and ST32 from among the processing steps of the presence or absence detection as shown in FIG. 30C is performed, the desired presence or absence detection is sufficiently possible. Of course, it does not matter even if the presence or absence detection is performed by the procedure other than the above described.

Further, it is possible to perform a re-imaging in step ST12 by moving the camera 150 to a position squarely opposite to the commodity C7 located at the taking-out portion 124*d* of the storing portion 124*a*. In this case, it is desirable to adopt the wire-shaped stopper portion 124*c* ' such as shown in FIG. 19 so that the under part of the commodity C7 is not concealed from the wall-shaped stopper portion 124*c*.

Next, the presence or absence of the commodity C7 of the taking-out portion 124*d* is discriminated from a determination result of step ST35 of FIG. 30C, and when the commodity C7 is not available, a notice that the commodity C7 is out of stock is displayed on the commodity selection button 107 having a out-of-stock indication function, and a purchaser's attention is instantaneously invited to the fact that the commodity C7 is not vendible (step ST15 of FIG. 30A).

Figure 42:
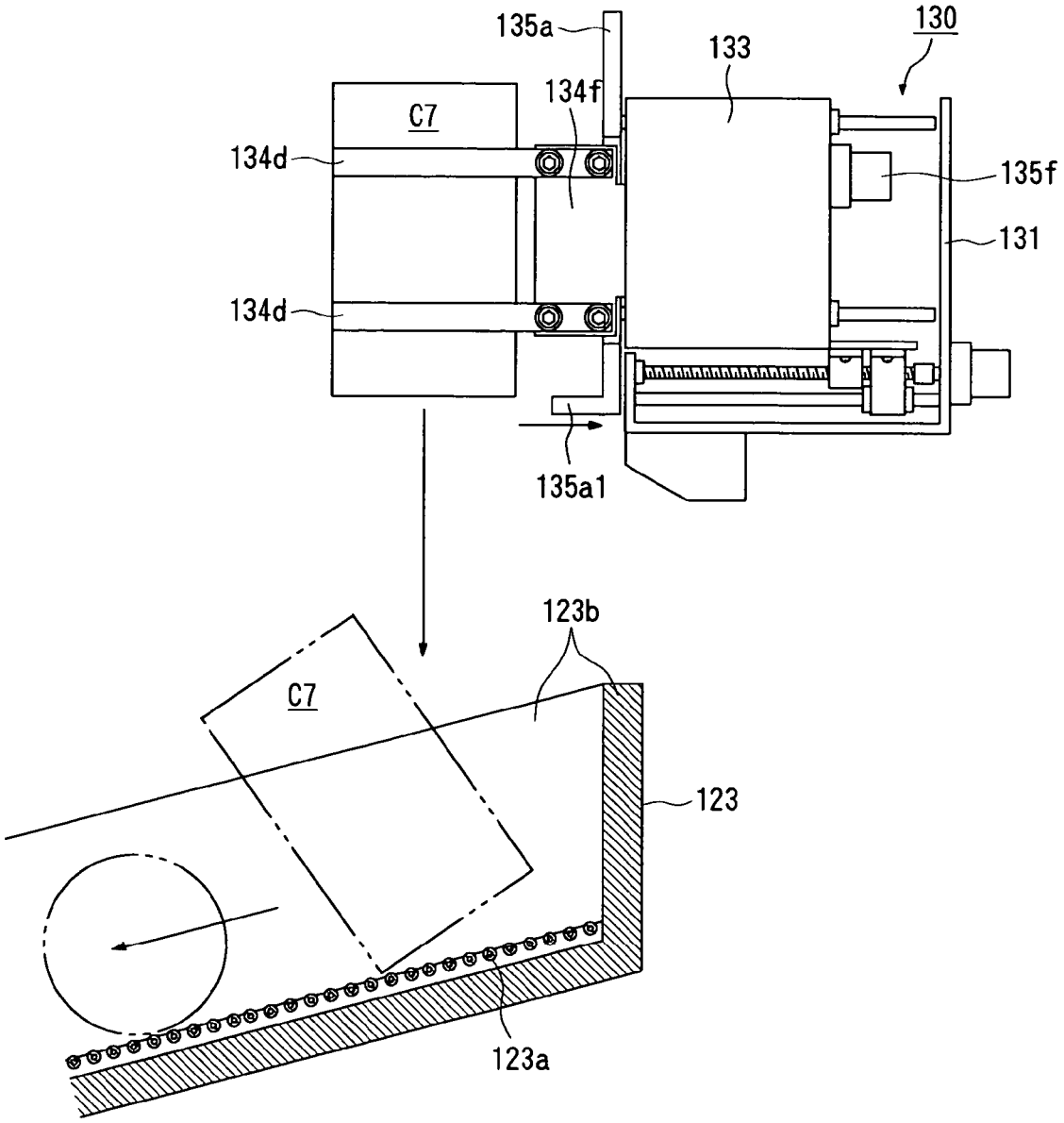
FIG. 42 is an explanatory view of the operation according to the taking-out and the movement of the commodity.

Further, when the commodity C7 is available, as shown in FIG. 42, the motor 143*a* of the up-and-down slider drive mechanism and the motor 144*a* of the left-and-right slider drive mechanism are operated so as to move the up-and-down slider 144 and the left-and-right slider 131, so that the commodity C7 gripped by both the fingers 134*a* and 134*d* is moved to a carrying-out position set above at the rear portion of the chute 123, and is stopped. Since the commodity C7 gripped by both the fingers 134*a* and 134*d* is supported by the lower end projection portion 135*a*1 of the bearing member 135*a*, the commodity C7 will never fall down by vibration, shock and the like in the course of moving to the carrying-out position. Subsequently, the motor 135*f* of the bearing member 135 is operated so as to allow the bearing member 135*a* to retreat from the advanced position, and at the same time, the right finger motor 134*j* and the left finger motor 134*l* of the hand mechanism 134 are operated so as to spread both the fingers 134*a* and 134*d* to the fullest extent, so that the commodity C7 is allowed to fall down on the chute 123, thereby performing the carrying-out of the commodity (step ST16 of FIG. 30A). The commodity C7 fell down on the chute 123 slides or rotates according to the inclination of the chute 123 so as to move forward, and is delivered to the commodity vendition port 108 of the door 101 through a flap door.

While flowchart shown in FIG. 30A shows that the re-imaging and the presence or absence detection are performed by restoring the hand unit 130 to the imaging position, the processing of step ST11 to ST15 is performed after step ST16, and then, the re-imaging and the presence or absence detection may be performed by restoring the hand unit 130 to the imaging position after carrying out the commodity. Further, in the processing of the position recognition of step ST14, the determination of the presence or absence of the commodity is made at the same time, and in the case that the commodity is present, the process moves to step ST5, and in the case that the commodity is absent, an out-of stock indication is displayed, so that the process may move to step ST1.

The taking-out and the movement of the commodities G1, and G3 to G18 other than commodity C7 are the same as described above.

In this way, according to the vending machine of the second embodiment, the storing tray 124 capable of storing a plurality of commodities (C1 to C18) in an upright state is adopted as storing means, and the means including the hand mechanism 134 capable of gripping the commodity (G1 to G18) located at the taking-out portion 124*d* of the predetermined storing portion 124*a* as remaining in an upright state and the mechanism capable of moving the hand mechanism 134 up and down, left and right, and back and forth is adopted as common carrying out means by a plurality of storing means (storing portion 124*a*). Hence, the constitution of the storing means can be simplified, and moreover, the necessity of providing the carrying-out means for every storing means can be eliminated, thereby reducing manufacturer's cost of the vending machine. That is, the reduction of manufacturer's cost and the lowering of production cost of the vending machine are made possible, and the profit augmentation due to production and distribution of the vending machine can be attempted.

Further, since the storing portion 124*a* having the inclined bottom surface for allowing the commodities (C1 to C18) to slide as remaining in an upright state to the taking-out portion 124*d* is used as the storing means, regardless of the number of stored commodities, the movement of the commodities (C1 to C18) to the taking-out portion 124*d* and taking-out of the commodities (C1 to C18) from the taking-out portion 124*d* can be accurately performed by the hand mechanism 134. Above all, if the bottom surface including a plurality of rollers 124*e* lined up in parallel back and forth is adapted as the inclined bottom surface, the sliding of the commodities can be made much smoother.

Further, since the hand mechanism 134 having two right fingers 134*a* and two left fingers 134*g* disposed in opposition to each other is used as the hand mechanism, the gripping by holding the commodities (C1 to C18) can be made better. Furthermore, when a force exceeding the biasing force of the spring 134*b* and the 134*e* acts externally, a constitution is adapted such that both the fingers 134*a* and 134*d* can move in parallel so as to separate externally from each support member 134*c* and 134*f*. Hence, all the commodities (C1 to C18) can be gripped by the same force controlled by the biasing force of the springs 134*b* and 134*e*, and no deformation, damage and the like is caused to the commodities (C1 to C18) when the commodities (C1 to C18) are gripped by both the fingers 134*a* and 134*d*.

Further, since the bearing member 135*a* supporting the under surface of the commodities (C1 to C18) gripped by both fingers 134*a* and 134*g* of the hand unit 132 and capable of moving back and forth is used, the commodities (C1 to C18) can be reliably prevented from falling down even if vibration, shock and the like are applied in the course of gripping and carrying out the commodities (C1 to C18) gripped by both the fingers 134*a* and 134*d*.

Further, since the commodity (C1 to C18) located in the taking-out portion 124*d* of the storing portion 124*a* are imaged by the camera 150 provided on the hand unit 130, and based on that image data, the position of the hand unit 130 before gripping the commodity (C1 to C18) located at the taking-out portion 124*d* can be accurately decided, the gripping of the commodity (C1 to C18) by both the fingers 134*a* and 134*d* is accurately performed so that the problem such as taking-out mistakes and falling down of the commodities after taken out and the like can be prevented from occurring.

Further, since the position of the commodity (C1 to C18) located at the taking-out portion 124*d* is recognized by the image processing, and based on that recognition, the moving distance of the right fingers 134*a* and the left fingers 134*d* is changed, thereby performing the gripping by both the fingers 134*a* and 134*d* without moving the commodity (C1 to C18), the commodity (C1 to C18) at the time of gripping can be prevented from moving left and right to lean or falling down from occurring.

Further, since the moving means comprising the up-and-down slider 144 capable of moving up and down, the up-and-down slider drive mechanism for moving the up-and-down slider 144 up and down, the left and-right slider 131 provided on the up-and-down slider 144 and capable of moving left and right, the left-and-right slider drive mechanism for moving the left-and-right slider 131 left and right, the back-and-forth slider 133 provided on the left-and-right slider 131 and capable of moving back and forth, and the back-and-forth slider drive mechanism for moving the back-and-forth slider 133 back and forth is used as the moving means of the hand mechanism 134, the hand mechanism 134 can be accurately moved up and down, left and right, and back and forth, thereby accurately performing the taking-out and the movement of the desire commodity.

Further, the presence or absence of the commodity (C1 to C18) of the taking-out portion 124*d* is detected based on the image data obtained by the camera 150, and when the commodity receiving a vendition request is out of stock, since the out-of-stock indication is displayed, the purchaser is reliably prevented from being annoyed with inconvenience by an instantaneous display of the out-of-stock indication.

Hereinafter, a partially modified mode according to the second embodiment will be described.

While the above described explanation shows that, when both the fingers 134*a* and 134*d* of the hand mechanism 134 are moved inward to grip the commodity (C1 to C18), the left and right clearance between both the fingers 134*a* and 134*d* is moved so as to be made about 3 to 5 mm smaller in advance than the diameter and the width of the commodity, a retreat distance after both the fingers 134*a* and 134*d* contact the commodity (C1 to C18) may be electrically detected to decide the stop position of both the fingers 134*a* and 134*d*. Specifically, a microswitch is disposed outside both the fingers 134*a* and 134*d*, and when both the fingers 134*a* and 134*d* are turned ON by the microswtich, the inward movement of both the fingers 134*a* and 134*d* may be allowed to stop. Further, in the interior of both the fingers 134*a* and 134*d*, there is provided a piezoresistive element such as a pressure sensitive rubber and the like, and when a pressure value detected by the piezoresistive element reaches a predetermined value, the inward movement of both the fingers 134*a* and 134*d* may be allowed to stop.

Further, while the above-described explanation shows that the commodities (C1 to C18) stored by the storing portion 124*a* of the storing tray 124 are allowed to abut against the stopper portion 124*c* so as to be stopped at the taking-out portion 124*d*, when the height of the stopper portion 124*c* is low, there is a possibility of the commodity being high in height falling down to the hand unit side in the taking-out portion 124*d*.

Figure 43A:
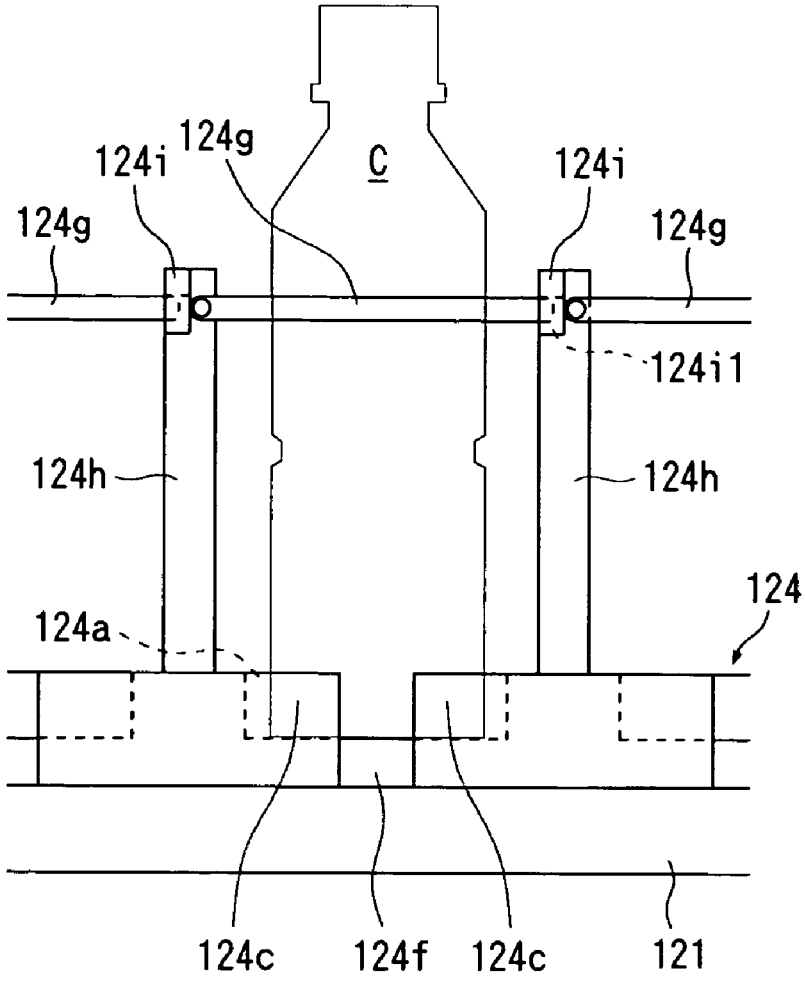
FIG. 43A is a rear surface view showing a modified embodiment of the storing tray.
Figure 43B:
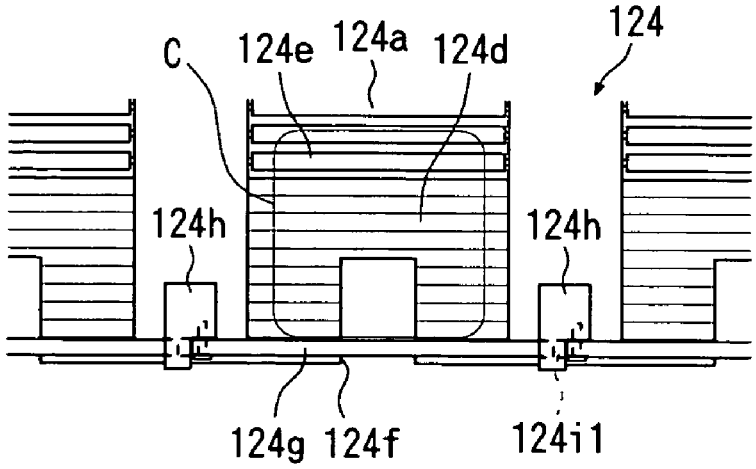
FIG. 43B is a top view thereof.

To exclude such a possibility, a retractable bar 124*g* as shown in FIGS. 43A and 43B may be provided in the front end portion of each storing portion 124*a*. This retractable bar 124*g* composed of an elongated plate member or a rod-like member, and is rotatably supported by one of leg portions 124*h* raised at both end portions of the taking-out portion 124*d*, and is biased counter-clockwise in FIG. 43 by springs (illustration omitted). In the other leg of the leg portions 124*h*, there is provided a stopper portion 124*i* comprising a notch 124*i*1 for receiving the other leg of the retractable bar 124*g*.

The retractable bar 124*g* takes an almost horizontal state as a steady position in which it has the other end thereof inserted into the notch 124*i*1 of the stopper portion 124*i* and stops. The commodity C located at the taking-out position 124*d* is prevented from falling down to the hand unit side by the retractable bar 124*g* located above the stopper portion 124*c*.

In the case that such a retractable bar 124*g* is provided in the front end portion of each storing portion 124*a*, when the commodity C located at the taking-out position 124*d* is taken out by the hand unit 130, it is necessary to push downward the retractable bar 124*g* so as not to obstruct the taking-out of the commodity.

As for the method for pushing downward the retractable bar 124*g* when the commodity C is taken out, there are thought of a method (1) in which the retractable bar 124*g* is pushed downward by the downside finger 134*d* when the hand unit 130 is lowered after imaging, and a method (2) in which the retractable bar 124*g* is pushed downward by an exclusive lever when the hand unit 130 is lowered after imaging.

When the method (1) is realized, before the hand unit 130 is lowered from the imaging position as shown in FIG. 29 or in the course of lowering, the back-and-force slider 133 is slightly advanced from a retreated position to a position in which the front end of the downside finger 134*d* contacts the retractable bar 124*g*, so that the retractable bar 124*g* may be pushed downward by the downside finger 134*d*.

Figure 44:
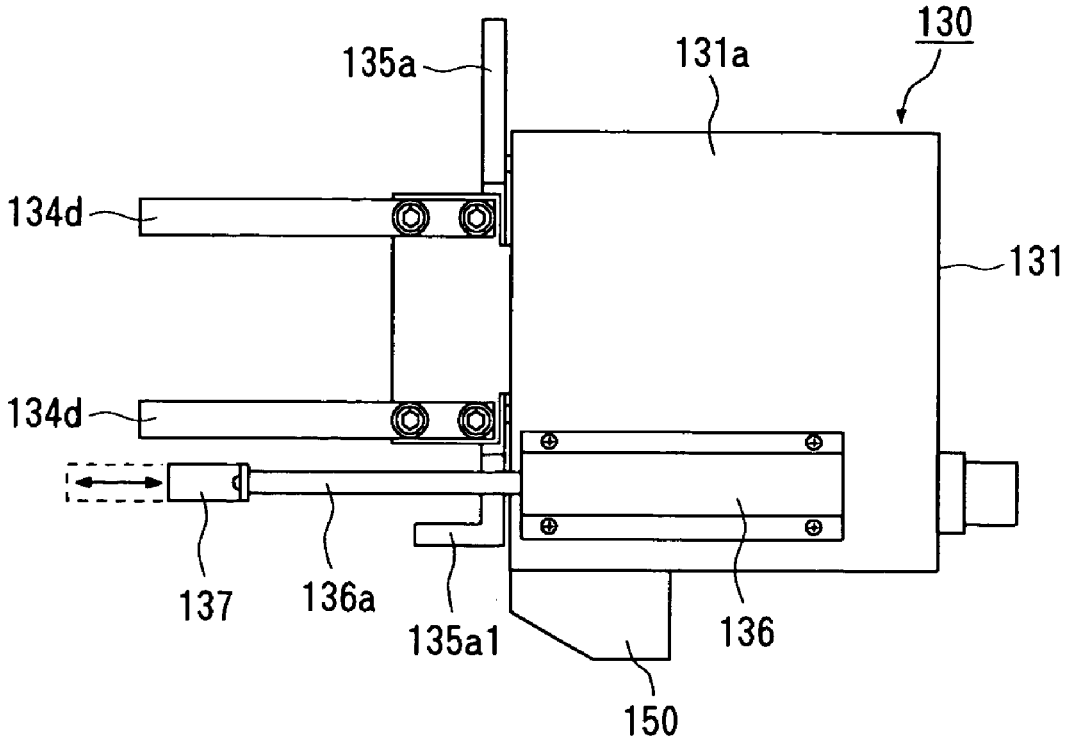
FIG. 44 is a right side view showing a modified embodiment of the hand unit.
Figure 45:
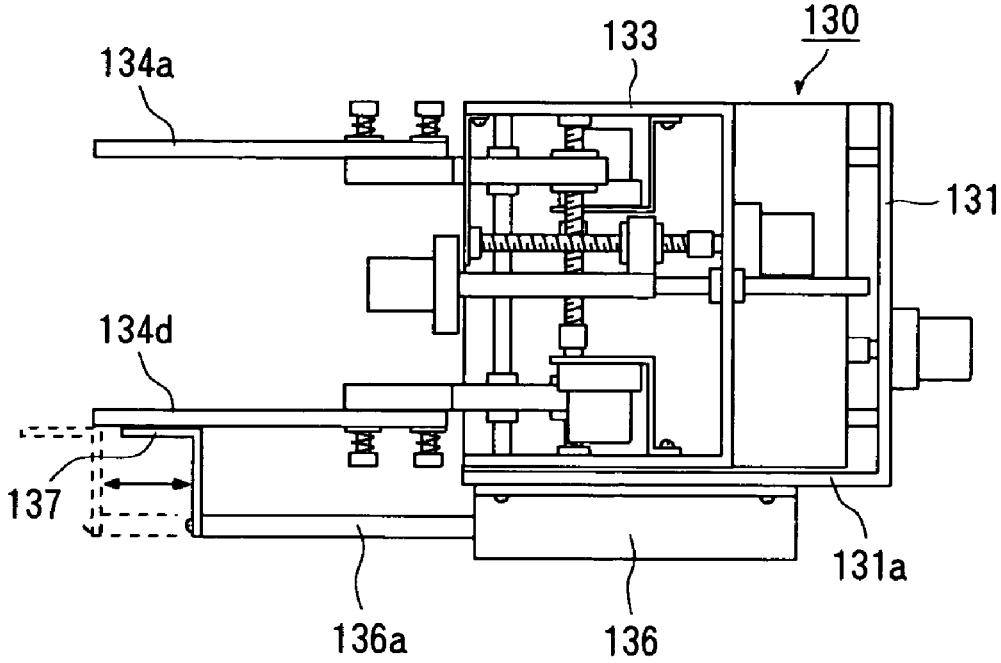
FIG. 45 is a top view of the hand unit shown in FIG. 44.

When the method (2) is realized, a constitution may be adopted such that, as shown in FIGS. 44 and 45, a wall surface 131*a* is provided on the left-and-right slider 131 of the hand unit 130, and this wall surface 131*a* is attached with a lever drive mechanism 136 capable of moving back and forth a shaft 136*a* by a solenoid, and the front end of the shaft 136*a* is attached with a lever 137.

Figure 46:
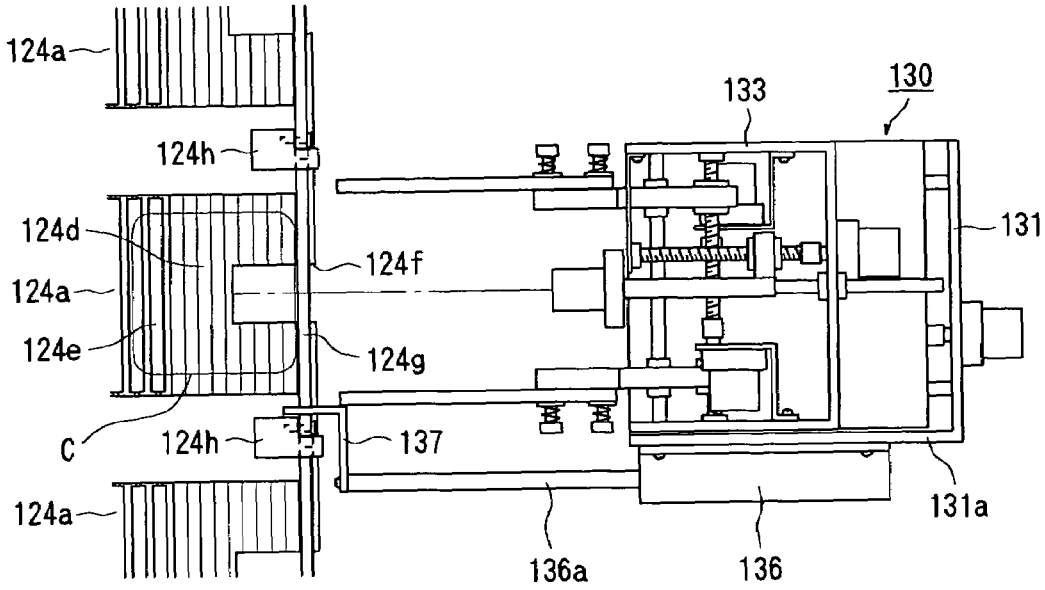
FIG. 46 is an explanatory view of an operation of the storing tray and the hand unit shown in FIGS. 43 and 44.
Figure 47A:
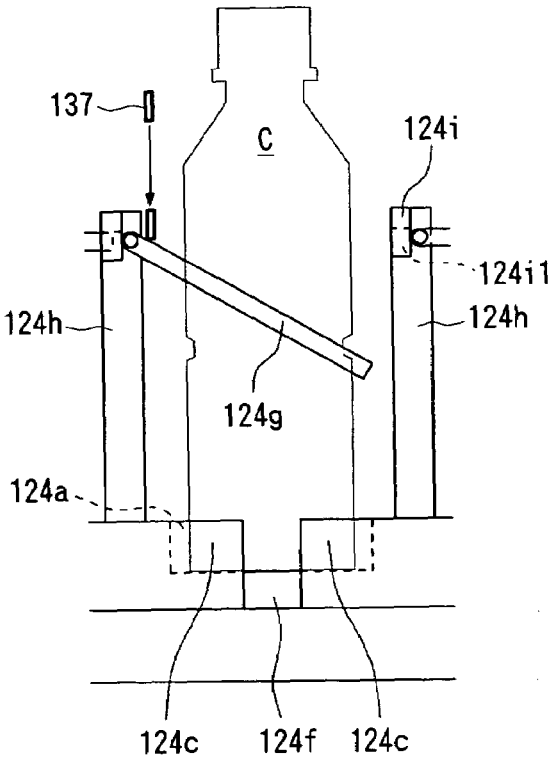
FIG. 47 is an explanatory view of the operation of the storing tray and the hand unit shown in FIGS. 43 and 44.
Figure 47B:
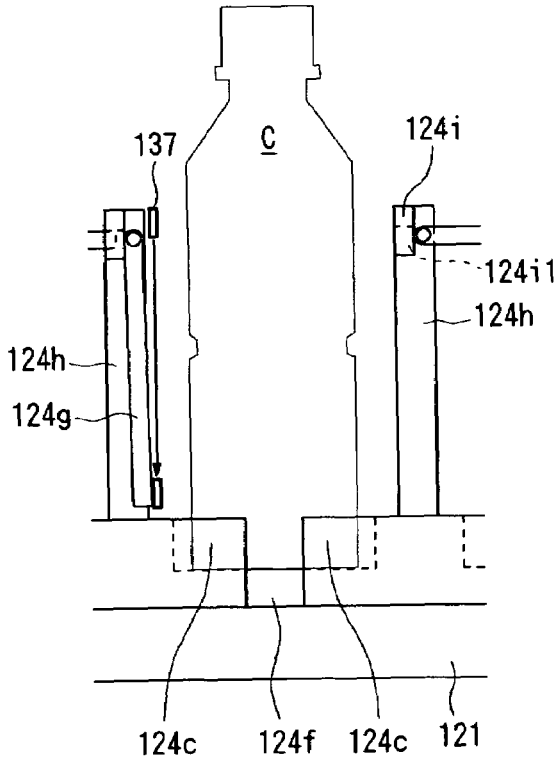

FIGS. 46 and 47 show a pushing down operation of the retractable lever 124*g* by the lever 137. Before the hand unit 130 is lowered from the imaging position as shown in FIG. 29 or in the course of lowering, if the lever 137 is allowed to advance by the lever drive mechanism 136 and project in front further forward than the front end of the fingers 134*a* and 134*d*, the retractable lever 124*g* can be pushed down by this lever 137.

Further, while the above-described explanation shows that the commodity (C1 to C18) located at the taking-out position 124*d* of the storing portion 124*a* is imaged at the imaging position by the camera 150, since the quality of the image took in is lowered if dust or water droplet adheres on the transparent plate 156, it is desirable to remove the dust or the water droplet after the door 101 is opened or for every imaging for every predetermined period of time.

Figure 48:
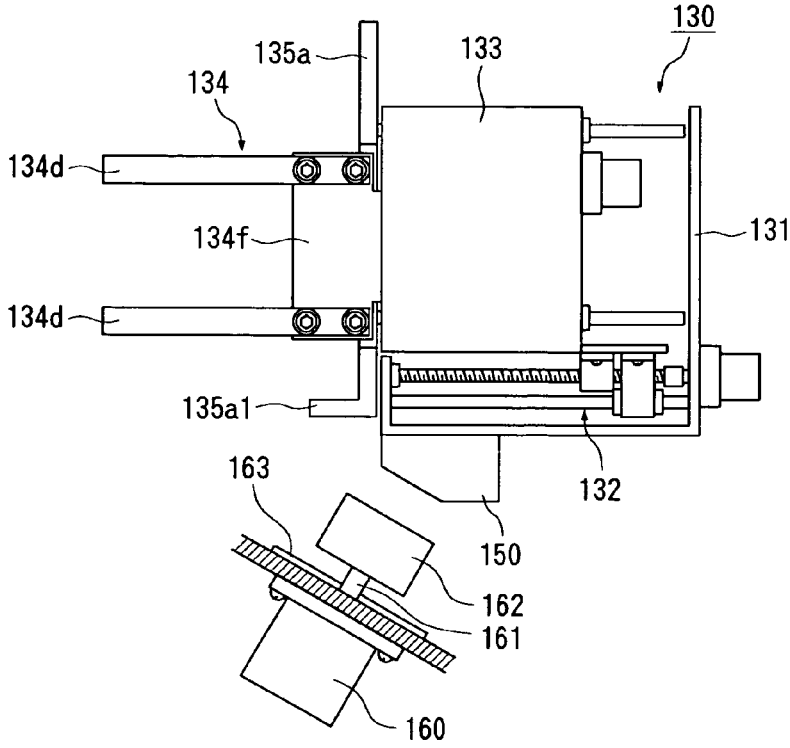
FIG. 48 is a view showing a device constitution for cleaning a transparent plate of the camera.

FIG. 48 shows a device constitution for removing the dust or the water droplet adhered on the transparent plate 156. The constitution is composed of a wiper drive mechanism 160 capable of advancing and retreating a shaft 161 by the solenoid, a wiper 162 attached to the top end of the shaft 161, and a calibration object of shooting 163.

The wiper 162 is composed of a synthetic rubber, a flexible plastic and the like, and is allowed to contact the transparent plate 156 under the biasing by the springs (illustration omitted) disposed between them and the shaft 161 with the shaft 161 in an extended state. Further, the calibration object of shooting 163 has a black lattice pattern laid on a white background, and the image data obtained when the calibration object of shooting 163 is imaged by the camera 150 is utilized to detect a dirt state of the transparent plate 156, thereby determining use or disuse of cleaning from the detection result.

Figure 49:
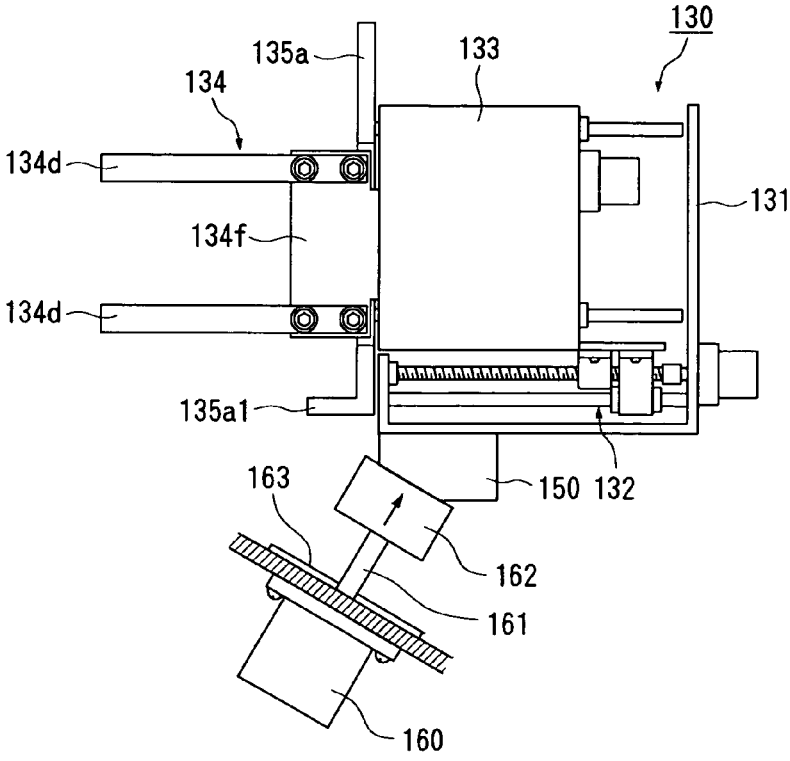
FIG. 49 is an explanatory view of the operation of the device shown in FIG. 48.

As shown in FIG. 49, when it is necessary to clean the transparent plate 156, the camera 150 (hand unit 130) is moved to a position in which the wiper 162 and the transparent plate 156 are squarely opposed to each other, and here, the shaft 161 of the wiper drive mechanism 160 is expanded to allow the wiper 162 to contact the transparent plate 156, and at the same time, the camera 150 is moved left and right or in any direction, and is cleaned in order to prevent the dust and the water droplet once removed from adhering again.

After cleaning, the calibration object of shooting 163 is again imaged by the camera 150 so as to detect a dirt state of the transparent plate 156, and if the dirt still remains, the cleaning operation is again repeated.

The preferred embodiments described in the specification are considered in all respects as illustrative and not restrictive. The scope of the invention is indicated by the appended claims, and all the modifications that come within the meaning of these claims are intended to be embraced in the present invention.

What is claimed is:

1. A vending machine, comprising:

a plurality of storing means each capable of storing a plurality of commodities in an upright state;

a taking-out position for a commodity being provided with each of the plurality of storing means;

gripping means capable of gripping the commodity as remaining in an upright state;

moving means capable of moving the gripping means up and down, left and right, and back and forth; and a carrying-out position for the commodity being provided in the vending machine;

wherein each of the plurality of storing means has an inclined bottom surface for sliding the commodities as remaining in the upright state to the taking-out position, left and right guide portions for controlling a sliding direction of the commodities, and a stopper portion for stopping the commodities and locating one of the commodities at the taking-out position, whereby the vending machine performs a carrying-out of the commodity by gripping and taking out the commodity located at the taking-out position of a predetermined storing means by the gripping means, moving the gripping means to the carring-out position, and releasing the gripping of the commodity by the gripping means at the carrying-out position.

2. The vending machine according to claim 1, wherein the inclined bottom surface includes a plurality of rollers lined up in parallel back and forth.

3. The vending machine according to claim 1, wherein the left and right guide portions are provided with a left and right interval so that the commodities line up almost in a line toward the taking-out position.

4. The vending machine according to claim 1, wherein the gripping means comprises at least a pair of left and right fingers for gripping the commodity, and a finger drive mechanism for open-and-close driving the fingers.

5. The vending machine according to claim 4, wherein the drive mechanism includes a left finger drive mechanism and a right finger drive mechanism.

6. The vending machine according to claim 4, wherein the gripping means comprises a bearing member for supporting the under surface of the commodity held by the fingers, and a bearing member drive mechanism for moving the bearing member back and forth.

7. The vending machine according to claim 1, wherein the moving means comprises an up-and-down slider capable of moving up and down, an up-and-down slider drive mechanism for moving the up-and-down slider, a left-and-right slider provided on the up-and-down slider and capable of moving left and right, a left-and-right slider drive mechanism for moving the left-and-right slider left and right, a back-and-forth slider provided on the left-and-right slider and capable of moving back and forth, and a back-and-forth drive mechanism for moving the back-and-forth slider back and forth.

8. The vending machine according to claim 1, further comprising:

imaging means provided on the gripping means for imaging the commodity located at the taking-out position and obtaining an image data, and position correction means for performing a positioning of the gripping means before gripping the commodity located at the taking-out position based on the image data obtained by the imaging means.

9. The vending machine according to claim 8, wherein the position correction means includes means for processing the image data obtained by the imaging means and recognizing back-and-forth and left-and-right positions of the commodity located at the taking-out position.

10. The vending machine according to claim 8, further comprising:

presence or absence discriminating means for discriminating the presence or absence of the commodity located at the taking-out position based on the image data obtained by the imaging means, and indication means for displaying an out-of-stock indication when the commodity is out of stock.

* * * * *